US012123113B2

(12) United States Patent
Jones et al.

(10) Patent No.: US 12,123,113 B2
(45) Date of Patent: Oct. 22, 2024

(54) GEOSYNTHETIC FABRIC WITH DIFFERENTIAL WICKING CAPABILITY

(71) Applicant: NICOLON CORPORATION, Pendergrass, GA (US)

(72) Inventors: David Michael Jones, Buford, GA (US); Kevin Nelson King, Mount Airy, GA (US); Zehong Yuan, Duluth, GA (US)

(73) Assignee: Nicolon Corporation, Pendergrass, GA (US)

( * ) Notice: Subject to any disclaimer, the term of this patent is extended or adjusted under 35 U.S.C. 154(b) by 258 days.

(21) Appl. No.: 17/847,355

(22) Filed: Jun. 23, 2022

(65) Prior Publication Data

US 2022/0411974 A1 Dec. 29, 2022

Related U.S. Application Data

(60) Provisional application No. 63/215,238, filed on Jun. 25, 2021.

(51) Int. Cl.

| | |
|---|---|
| ***D03D 15/49*** | (2021.01) |
| ***D02G 1/16*** | (2006.01) |
| ***D02J 1/02*** | (2006.01) |
| ***D02J 1/08*** | (2006.01) |
| ***D03D 15/283*** | (2021.01) |
| ***D03D 15/44*** | (2021.01) |
| ***D06M 23/14*** | (2006.01) |

(52) U.S. Cl.

CPC ..... *D03D 15/49* (2021.01); *D02G 1/161* (2013.01); *D02J 1/02* (2013.01); *D02J 1/08* (2013.01); *D03D 15/283* (2021.01); *D03D 15/44* (2021.01); *D06M 23/14* (2013.01); *D10B 2401/022* (2013.01); *D10B 2403/02412* (2013.01); *D10B 2505/204* (2013.01)

(58) Field of Classification Search

CPC .. D10B 2505/204; D03D 15/49; D02G 1/161; D02G 1/008; D02J 1/02; D02J 1/08; D06B 3/04; D06M 23/14

See application file for complete search history.

(56) References Cited

U.S. PATENT DOCUMENTS 4,428,698 A * 1/1984 Murphy ..... E01C 7/325 404/70
6,152,653 A 11/2000 Henry et al.
7,874,767 B2 1/2011 Jones et al.
(Continued)

OTHER PUBLICATIONS

International Search Report and Written Opinion issued in PCT International Application No. PCT/US2022/034701, ISA/EP European Patent Office, 10 pages.
(Continued)

*Primary Examiner* — Jasper Saberi
(74) *Attorney, Agent, or Firm* — Barnes & Thornburg, LLP; Tina M. Dorr

(57) ABSTRACT

The present invention is directed to a geotextile fabric including a plurality of wicking yarns each having a plurality of fibers with inter-fiber voids therebetween; wherein the inter-fiber voids of the plurality of wicking yarns has a water flow of about 0.05 milliliters per day per denier (ml/day/denier) to about 1.0 milliliters per day per denier. Further, the present invention is directed to a method of making such geotextile fabric.

24 Claims, 25 Drawing Sheets

(56) References Cited

U.S. PATENT DOCUMENTS

| | | | | |
|---|---|---|---|---|
| 8,070,395 | B2 | 12/2011 | Jones et al. | |
| 8,598,054 | B2 | 12/2013 | King et al. | |
| 2003/0182922 | A1* | 10/2003 | Peters | D02J 1/08 57/244 |
| 2006/0057376 | A1* | 3/2006 | O'Mara, Jr. | D02G 3/449 428/364 |
| 2017/0172074 | A1* | 6/2017 | Toye | D02J 1/08 |
| 2019/0309444 | A1* | 10/2019 | Rudisill | C08G 63/6886 |
| 2019/0366678 | A1* | 12/2019 | Jones | E02D 17/20 |
| 2020/0407890 | A1 | 12/2020 | Jones et al. | |
| 2023/0001667 | A1* | 1/2023 | Montes | C04B 35/453 |

OTHER PUBLICATIONS

"Standard Test Method for Determining the (In-plane) Flow Rate per Unit Width and Hydraulic Transmissivity of a Geosynthetic Using a Constant Head", ASTM D4716/D4716M-20, ASTM International, Published Jun. 2020, 9 pages.

"Standard Test Method for Determining Wicking of Fibrous Glass Blanket Insulation (Aircraft Type)", ASTM C1559-15, ASTM International, Published Oct. 2021, 3 pages.

"Standard Test Method for Permeability of Granular Soils (Constant Head)", ASTM D2434-19, ASTM International, Published Oct. 2019, 6 pages.

Kim et al., "Effects of Processing Parameters on the Mechanical Properties of Aramid Air Textured Yarns for Protective Clothing", AUTEX Research Journal, vol. 18, No. 2, Jun. 2018, 11 pages.

* cited by examiner

GEOSYNTHETIC FABRIC WITH DIFFERENTIAL WICKING CAPABILITY

CROSS-REFERENCE TO RELATED APPLICATION

This application is a U.S. nonprovisional patent application which claims priority to and the benefit of U.S. Provisional Patent Application No. 63/215,238, filed on Jun. 25, 2021, which is incorporated by reference herein in its entirety.

TECHNICAL FIELD OF THE INVENTION

The present invention is related generally to geosynthetic fabrics. More specifically, the present invention is related to geosynthetic wicking fabrics and structures employing same.

BACKGROUND OF THE INVENTION

Frost heave and thaw weakening can cause damage to various structures, including pavement structures, such as parking areas, roadways, airfields, etc., in northern regions. The formation of ice lenses in the pavement structure is a significant contributor to such damage. Three elements are necessary for ice lenses, and thus frost heave, to form. These are: (1) frost susceptible soil, (2) subfreezing temperatures, and (3) water. Often, water is available from the groundwater table, infiltration, an aquifer, or held within the voids of fine-grained soil. By removing any of the three elements above, frost heave and thaw weakening can be at least minimized or eliminated altogether.

Techniques have been developed to mitigate the damage to pavement structures caused by frost heave and thaw weakening. One such method involves removing the frost susceptible soils and replacing them with non-frost susceptible soils. The non-frost susceptible soil is placed at an adequate thickness to reduce the strain in the frost-susceptible soil layers below to an acceptable level. Other methods include use of insulation to reduce the freeze and thaw depth. In areas where removal of frost susceptible soils and reduction of subfreezing temperature are difficult and expensive, removal of water can lead to savings in construction costs by reducing the formation of ice lenses. By breaking the capillary flow path, frost action can be less severe.

A capillary barrier is a layer of coarse-grained soils or geosynthetic in a fine-grained soil that (i) reduces upward capillary flow of soil water due to suction gradient generated by evaporation or freezing, and/or (ii) reduces or prevents water from infiltrating from the overlying fine-pored unsaturated soil into the soil below the capillary barrier. In the latter case, if the capillary barrier is sloped, the infiltrating water flows in the fine soil downwards along the interface with the capillary barrier. Geosynthetic drainage nets (geonets) have been found to serve as capillary barriers because of their large pore sizes. The performance of nonwoven geotextiles as a capillary barrier appears to be compromised by soil intrusion into their interiors, decreasing the pore size and increasing the affinity of the material to water.

The above-mentioned capillary barriers attempt to cut off the capillary water flow by generating a horizontal layer with very low unsaturated permeability under suction. The whole structure is permeable for downward rainfall infiltration. This type of capillary barrier requires that the barrier thickness exceed the height of the capillary rise of water in them. In addition, it provides conditions suitable for water vapor flow because of their high porosity and comparatively low equilibrium degrees of saturation.

In another example, expansive clay soils swell and expand, more than other types of soils, with changes in moisture content, as well as shrink when they lose their moisture through seasonal and climatic changes. Expansive clay soils thus shrink more than non-expansive clay soils and thus can produce problematic cracks. For example, in a roadway, expansive clay soils tend to produce longitudinal cracks parallel to the traffic direction just at the edges of the concrete asphalt border. Thus, expansive clay soils need a material to normalize the moisture content to minimize the differential moisture movement.

SUMMARY OF THE INVENTION

The present invention is directed to a geotextile fabric including a plurality of wicking yarns each having a plurality of fibers with inter-fiber voids therebetween. The inter-fiber voids of the plurality of wicking yarns have a water flow of about 0.05 milliliters per day per denier (ml/day/denier) to about 1.0 milliliters per day per denier.

Another aspect of the invention is directed to a method for making a geotextile fabric including a plurality of wicking yarns, each having a plurality of fibers with inter-fiber voids therebetween. The method includes weaving the plurality of wicking yarns in an axis of the fabric.

Yet another aspect of the invention is directed to a geotextile fabric including a plurality of texturized (or textured) fibers with inter-fiber voids therebetween. The geotextile fabric has a water flow rate of at least 2 liters/linear foot per day.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the present invention. It is important, therefore, that the claims be regarded as including such equivalent constructions insofar as they do not depart from the spirit and scope of the present invention.

Other advantages and capabilities of the invention will become apparent from the following description taken in conjunction with the accompanying drawings showing the embodiments and aspects of the present invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

DETAILED DESCRIPTION OF THE INVENTION

Figure 1:
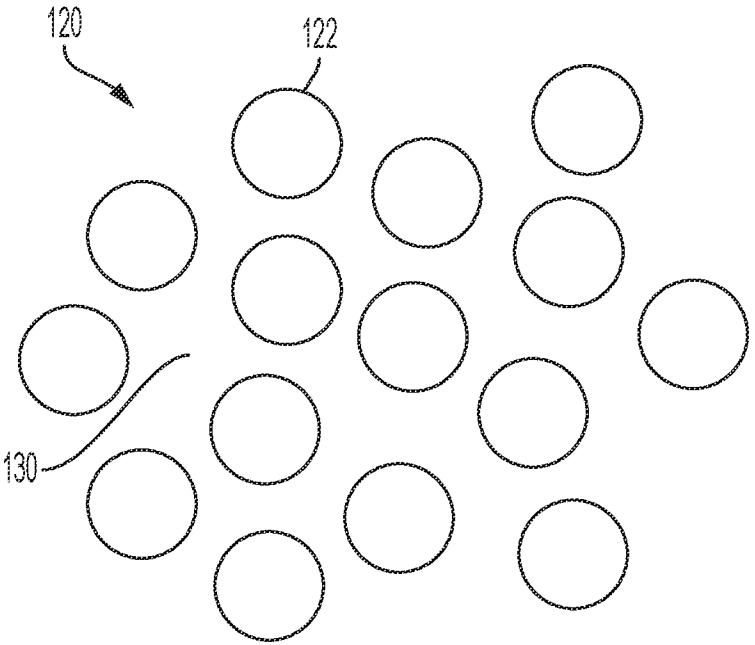
FIG. 1 illustrates cross-sectional side views of pluralities of wicking yarns, each having a plurality of fibers with inter-fiber voids therebetween, in accordance with aspects of the invention.
Figure 1:
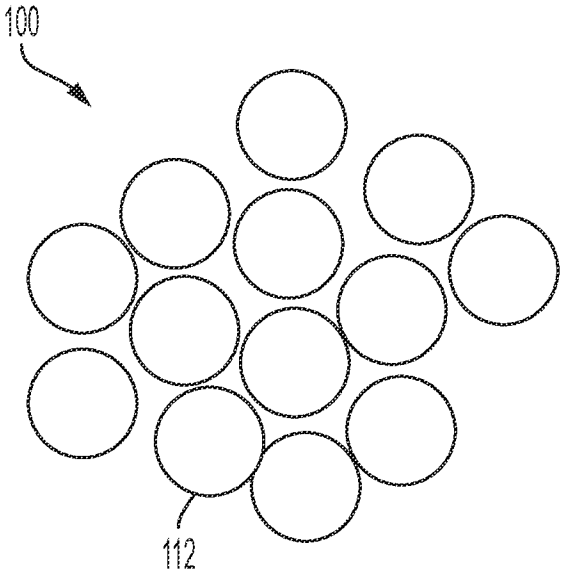

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items.

It will be understood that when an element is referred to as being "on" another element, it can be directly in contact with the other element or intervening elements may be present therebetween. In contrast, when an element is referred to as being "directly on" another element, there are no intervening elements present. Expressions such as "at least one", "at least one kind", "one or more kinds", or "one or more" when preceding a list of elements, modify the entire list of elements and do not modify the individual elements of the list. As used herein, the term "combination thereof" is used to refer to a mixture or alloy of two or more components described above.

As used herein, the term "including" is used to indicate that other components may be added or/and interposed, rather than excluding other components, unless specifically stated to the contrary. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

As used herein, the term "first", "second", or the like do not indicate order, quantity, or importance, and are used to distinguish one element from another. It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present embodiments.

The terminology used herein is for the purpose of describing particular embodiments only and is not intended to be limiting. As used herein, unless otherwise indicated or explicitly contradicted by context, it should be interpreted as including both singular and plural. For example, as used herein, the singular forms "a," "an," and "the" are intended to include the plural forms as well, unless the context clearly indicates otherwise. As used herein, the term "or" means "and/or" unless otherwise specified.

Throughout the present specification, "an embodiment", "example embodiment", "exemplary embodiment", etc. are included in at least one embodiment in which specific elements described in connection with the embodiment are included in this specification, which means that these elements may or may not exist in another embodiment. Further, it should be understood that the described elements may be combined in any suitable manner in various embodiments.

Unless otherwise defined, all terms including technical and scientific terms used herein have the same meaning as commonly understood by one of ordinary skill in the art to which this invention belongs. All cited patents, patent applications and other references are incorporated herein by reference in their entirety. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein. However, if the terms in this specification contradict or conflict with the terms of the incorporated references, the terms from this specification take precedence over the conflicting terms in the incorporated reference.

While specific embodiments and implementations have been described, alternatives, modifications, variations, improvements and substantive equivalents that are currently unexpected or unforeseeable may occur to applicants or those skilled in the art. Accordingly, the appended claims and amendments are intended to include all such alternatives, modifications, improvements and substantial equivalents.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±20%, 10%, 5% of the stated value.

The terms "textured" or "texturized" are used interchangeably throughout the specification to indicate textured or texturized matter.

The present invention is directed to a geotextile fabric including a plurality of wicking yarns each having a plurality of fibers with inter-fiber voids therebetween, which optimize capillary tension in substantially a single axis to enhance moisture movement both in-plane and cross-plane around the geotextile fabric, compared to conventional fabric. The inter-fiber voids of the plurality of wicking yarns have a water flow of about 0.05 milliliters per day per denier (ml/day/denier) to about 1.0 milliliters per day per denier.

U.S. Pat. No. 6,152,653, describes a geocomposite capillary barrier drain (GCBD) for displacing water from beneath pavement. The GCBD system employs a transport layer, a capillary barrier, and a separator layer. Specifically, the GCBD transport layer utilizes the capillary properties of a fiberglass fabric to displace water away from the paved surface. In accordance with aspects of the present invention, the novel geotextile fabric described herein can be incorporated into a GCBD system by replacing the fiberglass fabric. Further, the novel geotextile fabric of the present invention can be employed to replace the GCBD system altogether. The novel geotextile fabric of the present invention can include a plurality of wicking yarns, each having a plurality of fibers with inter-fiber voids therebetween. In aspects, a cross-sectional shape of each of the plurality of wicking yarns is round, oval, trilobal, multi-lobed, dumbbell, multi channeled, triangular with round edges, pillowed, or a combination thereof. In other aspects, the inter-fiber voids of the plurality of wicking yarns have a water flow of about 0.05 milliliters per day per denier (ml/day/denier) to about 1.0 milliliters per day per denier.

In accordance with the present invention, a geotextile fabric includes a plurality of wicking yarns, each having a plurality of fibers with inter-fiber voids therebetween, wherein the inter fiber voids of the plurality of wicking yarns have a water flow of about 0.05 milliliters per day per denier (ml/day/denier) to about 1.0 milliliters per day per denier. In an embodiment, the geotextile fabric is a woven fabric, a nonwoven fabric, or a combination thereof. For example, the plurality of wicking yarns each having a plurality of fibers with inter-fiber voids therebetween can be woven into the geotextile fabric in either the warp or the weft directions. The plurality of wicking yarns has a round, an oval, a trilobal, a multi-lobed, a dumbbell, a multi channeled, a triangular with round edges, or a pillowed cross-section with a cross sectional surface area of about 1000 square centimeter per gram (cm2/g) to about 5000 square centimeter per gram. Yet, in another aspect, a fabric made from the geotextile fabric has a flow rate of about 2 liter per linear foot per day to about 20 liters per linear foot per day at zero gradient under load. Still, in another aspect, each of the plurality of wicking yarns of the geotextile fabric maintains unsaturated hydraulic conductivity in environments having a degree of saturation less than 100%. Unsaturated hydraulic conductivity refers to a measure of soil's ability to migrate water when soil pore space is not saturated with water. Different soils have different saturation points, the saturation point of a soil depends on the content, nature, and arrangement of the soil. In one or more embodiments, the plurality of wicking yarns of the geotextile remove moisture from a soil that has a saturation level less than 100%. For example, the plurality of wicking yarns of the geotextile remove moisture from a soil that has a saturation level less than about or in any range between 100%, 95%, 90%, 85%, 80%, 75%, 70%, 65%, 60%, 55%, 50%, 45%, 40%, 35%, 30%, 25%, 20%, 15%, 10%, and 5%. As indicated above, the geotextile fabric of the present invention finds utility in civil and environmental engineering applications.

Wicking Yarns

In one aspect of the present invention, a plurality of wicking yarns each having a plurality of fibers (the wicking fibers) with inter-fiber voids therebetween are woven into the geotextile fabric. As a result, a fluid, such as water, is transported along the plurality of wicking yarns, each having a plurality of fibers with inter-fiber voids therebetween, to the periphery of the geotextile fabric of the present invention. That is, the plurality of wicking yarns moves the fluid substantially along a single axis. The plurality of wicking yarns employed in the present invention has a water flow of about 0.05 milliliters per day per denier (ml/day/denier) to about 1.0 milliliters per day per denier. For example, in one or more embodiments, the plurality of wicking yarns employed in the present invention has a water flow of about or in any range between 0.05, 0.08, 0.10, 0.15, 0.18, 0.20, 0.22, 0.25, 0.28, 0.30, 0.33, 0.35, 0.38, 0.40, 0.43, 0.45, 0.48, 0.5, 0.55, 0,6, 0,65, 0.7, 0.75, 0.8, 0.85, 0.9, 0.95, and 1.0 milliliters per day per denier. Several types of wicking yarns can be employed in the present invention and are described below.

The wicking yarns include one or more polymers or copolymers. Non-limiting examples of polymers include polyesters, nylons, polyolefins, and cellulose esters. Fibers from poly(ethylene terephthalate) and polypropylene are useful in the present invention. In some embodiments, the denier of each fiber of the plurality of wicking fibers is between about 0.5 and about 250, or between about 30 and about 170.

In embodiments, each of the plurality of wicking yarns is made of a polyamide, a polyimide, a polyethylene, a polyester, a nylon, a polyolefin, a polystyrene, a cellulose ester, a cotton, a wool, a polyetheretherketone (PEEK), and natural fiber, or a combination thereof.

In one or more embodiments, each of the plurality of textured fibers is a polyamide, a polyimide, a polyethylene, a polyester, a nylon, a polyolefin, a polystyrene, a cellulose ester, a cotton, a wool, a polyetheretherketone (PEEK), and natural fiber, or a combination thereof. In some embodiments, each of the plurality of textured fibers is a poly (ethylene terephthalate). In some other embodiments, each of the plurality of textured fibers is a polypropylene. In some other embodiments, each of the plurality of textured fibers is a nylon.

As indicated above, the plurality of wicking yarns of the present invention can be made of any polymeric material that is insoluble in the fluid which is to be contacted with the geotextile fabric. For example, the polymer utilized can be a thermo-plastic polymer, which can be extruded and drawn via an extrusion process to form the final product. Non-limiting examples of suitable polymeric materials, in addition to polyester, polystyrene and polyolefins such as polyethylene and polypropylene, include polyamides, chemical cellulose-based polymers such as viscose and di- or tri-ace-. Co-, ter-, etc. polymers and grafted polymers can also be used. Thermoplastic polymers that can be employed in the present invention are polyesters, copolymers of dicarboxylic acids, glycols, esters thereof, or any combination thereof. The dicarboxylic acid and ester compounds used in the production of polyester copolymers are well known to those of ordinary skill in the art. Such polymers include terephthalic acid, isophthalic acid, p,p'-diphenyldicarboxylic acid, p,p'-dicarboxydiphenyl ethane, p,p'-dicarboxydiphenyl hexane, p,p'-dicarboxydiphenyl ether, p,p'-dicarboxyphenoxy ethane, and the like, and the dialkylesters thereof, which contain from 1 to about 5 carbon atoms in the alkyl groups thereof.

Aliphatic glycols useful for the production of polyesters. and copolyesters are the acrylic and alicyclic aliphatic glycols having from 2 to 10 carbon atoms, such as ethylene glycol, trimethylene glycol, tetramethylene glycol, pentamethylene glycol, and decamethylene glycol.

It is additionally contemplated to utilize copolymers or graft copolymers, terpolymers, chemically modified polymers, and the like, which permanently exhibit high surface hydrophilicity and do not require the use of wetting agents, which may wash away from the structure surface upon contact with fluids. Modified polymers that can exhibit permanent hydrophilicity include chemical cellulose polymers such as cellulose acetates. In addition, pigments, delusterants, and/or optical brighteners can be included in the polymer mixtures.

A type of polyester which can be employed in the present invention is glycol modified poly(ethylene terephthalnelate) (pETG) copolyester. Suitable pETG is available from Eastman Chemical Products, Inc. (Kingsport, Tenn., USA), under the name KODAR™ 6763, with a glass transition temperature of about 81° C.

Another factor affecting polymer choice is amenability to chemical modification of its surface for increasing various properties, for example, hydrophilicity. Thus, for the geotextile fabric intended for absorbing and/or transporting aqueous based solutions, it can be advantageous to use a polyester-based polymer rather than, for example, a polypropylene. However, this selection option is not meant to thereby limit the scope of the invention. Also, depending upon the intended use of the structures, it can be desirable that the polymer material utilized be flexible at the temperatures at which the structures are intended to be used. Flexibility will depend upon such factors as the thickness and dimensions of the geotextile fabric walls and base, as well as the modulus of elasticity. Thus, choice of polymer in this regard will be highly subject to the intended use and temperature conditions. Choice of such suitable polymer material is well within the ability of one of ordinary skill in the art.

Depending upon the intended use, the geotextile fabric can be made from polymers that are either hydrophilic or oleophilic, or can be treated to be hydrophilic or oleophilic.

The surface hydrophilicity of polymers used to make the geotextile fabric of the present invention can be increased to make the inter-fiber void walls more wettable to water or aqueous solutions by treatment with surfactants or other hydrophilic compounds (hereafter, collectively referred to as "hydrophilizing agents") known to those skilled in the art. Hydrophilizing agents include wetting agents such as polyethylene glycol monolaurates (e.g., PEGOSPERSE™ 200ML, a polyethylene glycol 200 monolaurate available from Lonza, Inc., Williamsport, Pa., USA), and ethoxylated oleyl alcohols (e.g., VOLPO™-3, available from Croda, Inc., New York, N.Y., USA). Other types of hydrophilizing agents and techniques can also be used, including those well known to those skilled in the fiber and textile arts for increasing wicking performance, improving soil release properties, etc. These include, for example, surface grafting of polyacrylic acid. Suitable commercially available hydrophilizing agents include ZELCON™ soil release agent, a nonionic hydrophile available from DuPont Co., Wilmington, Del. (USA) and Milease T™ comfort finish available from ICI Americas, Inc., Wilmington, Del., USA. In addition, ERGASURF, ceramic microbeads and vinyl pyrrolidone can be employed as hydrophilic or hygroscopic additives.

Figure 25:
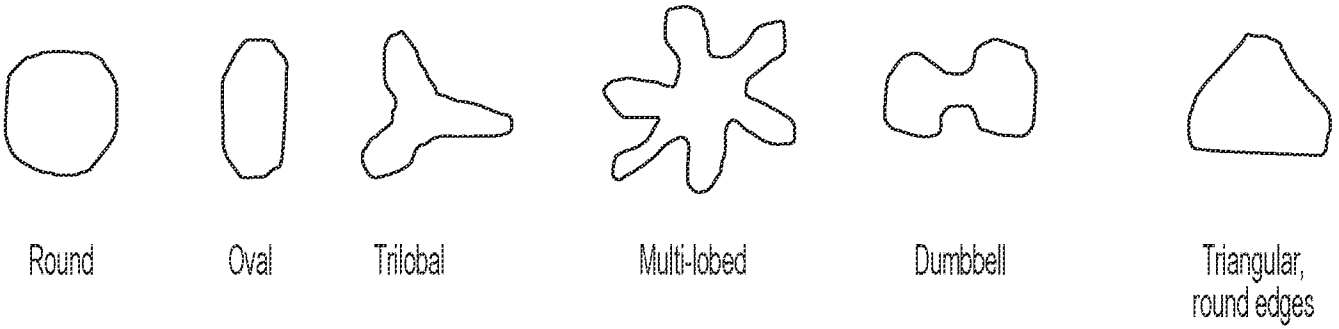
FIG. 25 shows examples of cross-sectional shapes for wicking yarns.

In one or more embodiments, a cross-sectional shape of each of the yarns of the plurality of wicking yarns is round, oval, trilobal, multi lobed, dumbbell, multi channeled, triangular with round edges, pillowed, or a combination thereof. FIG. 25 shows nonlimiting examples of cross sectional shapes for wicking yarns, such as round, oval, trilobal, multi-lobed, dumbbell, and triangular with round edges.

In embodiments, the geotextile fabric with the plurality of wicking yarns includes a plurality of textured wicking yarns. In one or more embodiments, the plurality of textured wicking yarns includes an air texturized wicking yarn, a wicking yarn mechanically texturized with friction or air, a staple spun texturized wicking yarn, or a combination thereof. In one or more embodiments, the plurality of textured wicking yarns includes the air texturized wicking yarn. It is understood that any suitable method resulting in inter-fiber voids can be used to texturize the plurality of wicking yarns to afford the plurality of textured wicking yarns.

In one or more embodiments, each fiber of the plurality of wicking yarns has a cross sectional surface area of about 1000 square centimeter per gram ($cm^2/g$) to about 5000 square centimeter per gram. For example, each fiber of the plurality of wicking yarns has a cross sectional surface area of about or in any range between 1000, 1200, 1500, 1700, 2000, 2200, 2500, 2700, 3000, 3200, 3500, 3700, 4000, 4200, 4500, 4700, and 5000 square centimeter per gram. For example, each fiber of the plurality of wicking yarns has a cross sectional surface area of about 1000 square centimeter per gram to about 1500 square centimeter per gram, about 1000 square centimeter per gram to about 2000 square centimeter per gram, about 1000 square centimeter per gram to about 3000 square centimeter per gram, about 1000 square centimeter per gram to about 4000 square centimeter per gram, or about 1200 square centimeter per gram to about 2500 square centimeter per gram.

In some embodiments, each yarn of the plurality of wicking yarns each has a cross-sectional surface area of about 1500 square centimeter per gram to about 3000 square centimeter per gram. In some embodiments, each yarn of the plurality of wicking yarns has a cross-sectional surface area of about 1243 square centimeter per gram. The cross-sectional surface area of the round fiber in an embodiment is calculated as follows:

$$\text{Denier}=g/cm^3*\text{surface area}$$

$$5\ g/9000\ \text{meters}*1.38\ g/cm^3$$

$$\text{therefore: } 5\ g/900{,}000\ cm*1.38=0.0000039 \text{ or } 3.9\times 10^{-6}$$

Surface area of a cylinder=2πrh+2πr2 where r is radius and h is height

Radius=0.0011 cm, length or height of 5 denier fiber is 180,000 cm, which provides a cross sectional surface area 1243 $cm^2$/gram per one 5 grams per denier (gpd) fiber.

In one or more embodiments, each yarn of the plurality of wicking yarns has a hydraulic improvement factor of about 0.5 to about 2 as measured by the American Association of State Highway and Transportation Officials (AASHTO) Guide for Design of Pavement Structures 1993, and the AASHTO Mechanistic Empirical Pavement Design Guide 2015. For example, each yarn of the plurality of wicking yarns has a hydraulic improvement factor of about or in any range between 0.5, 0.6, 0.7, 0.8, 0.9, 1, 1.1, 1.2, 1.3, 1.4, 1.5, 1.6, 1.7, 1.8, 1.9, and 2 as measured by the AASHTO Guide for Design of Pavement Structures 1993, and the AASHTO Mechanistic Empirical Pavement Design Guide 2015. For example, each yarn of the plurality of wicking yarns has a hydraulic improvement factor of about 0.5 to about 1.7, about 0.5 to about 1.5, about 0.5 to about 1.3, about 0.5 to about 1.1, about 0.5 to about 0.9, and about 0.5 to about 0.7 as measured by the AASHTO Guide for Design of Pavement Structures 1993, and the AASHTO Mechanistic Empirical Pavement Design Guide 2015.

In embodiments, a weight of each of the plurality of fibers is between about 0.5 denier and about 250 denier per filament. In one or more embodiments, the weight of each of the plurality of fibers is about or in any range between $10^{-6}$, $10^{-5}$, $10^{-4}$, $10^{-3}$, 0.01, 0.1, 0.5, 1.0, 5, 10, 15, 20, 25, 30, 35, 40, 45, 50, 55, 60, 65, 70, 75, 80, 85, 90, 95, 100, 110, 120, 130, 140, 150, 160, 170, 180, 190, 200, 210, 220, 230, 240, and 250 denier per filament. For example, the weight is between about $10^{-6}$ denier and about 70 denier, between about $10^{-6}$ denier and about 50 denier, between about $10^{-6}$ denier and about 30 denier, between about $10^{-6}$ denier and about 10 denier, between about $10^{-6}$ denier and about 1 denier, between about $10^{-6}$ denier and about $10^{-4}$ denier, between about $10^{-6}$ denier and about $10^{-2}$ denier, between about $10^{-6}$ denier and about $10^{-1}$ denier, between about 0.5 denier and about 10 denier, between about 0.5 denier and about 15 denier, between about 0.5 denier and about 20 denier, between about 0.5 denier and about 100 denier, between about 1 denier and about 100 denier, between about 1 denier and about 20 denier, between about 1 denier and about 10 denier, and between about 1 denier and about 5 denier per filament. In some embodiments, the weight of each of the plurality of fibers is between about 0.5 denier per filament and about 100 denier per filament. In some other embodiments, the weight of each of the plurality of fibers is between about 1 denier per filament and about 5 denier per filament.

In one or more embodiments, a cross-sectional shape of each of the plurality of wicking yarns is round, oval, trilobal, multi lobed, dumbbell, multi channeled, triangular with round edges, pillowed, or a combination thereof.

In one or more embodiments, the plurality of textured fibers includes air texturized fibers, fibers mechanically texturized with friction or air, staple spun texturized fibers, or a combination thereof. In one or more embodiments, the plurality of textured fibers includes the air texturized fibers. It is understood that any suitable method resulting in inter-fiber voids can be used to make the plurality of textured fibers.

Inter-Fiber Voids

Wicking yarns employed in the present invention include a plurality of fibers with inter-fiber voids therebetween. The plurality of wicking yarns each having a plurality of fibers with inter-fiber voids therebetween of the present invention provides flexible inter-fiber void structures. The actual length of the structure is limited only by practical concerns. Although the inter-fiber void structures thereof can have one inter-fiber void or a plurality of inter-fiber voids, for convenience the plural form "voids" is used with the intent that it shall refer to a singular "void" in structures having only one such inter-fiber void or a plurality of voids in structures having more than one inter-fiber void.

FIG. 1 shows a cross-section of plurality of wicking fibers. FIG. 1 (left) shows a cross section of non-textured wicking yarn 100, which includes a plurality of wicking fibers 112. The right side of FIG. 1 shows a cross section of textured wicking yarn 120, with a plurality of wicking fibers 122 with inter-fiber voids 130 in accordance with the present invention. The left to right side of FIG. 1 illustrates that texturization increases the size of inter-fiber voids 130 in the plurality of wicking yarn 120 compared to non-textured wicking yarn 100. The inter-fiber voids 130 provide channels for water flow through a capillary action. The plurality of fibers with inter-fiber voids having a void ratio in the range of about 0.8 to about 5 provides optimum capillary action and improves wicking ability. However, other shapes, such as oval, trilobal, multi lobed, dumbbell, multi channeled, triangular with round edges, pillowed, or a combination thereof, can be employed in the present invention. Certain fiber shapes such as round fibers do not have inherent wicking capabilities are not generally employed as wicking fibers. In contrast, fibers with non-round shapes, such as multi-lobed fibers, are employed as wicking fibers because of the presence of tiny channels that helps them to move water. Therefore, it is important to have an optimized void distance between the fibers to create inter-fiber voids with sufficiently large sizes and numbers. The void distances between the fibers have been optimized, and in particular, when more than 50% of the inter-fiber voids are less than about 100 microns, such voices provide optimal capillary suction.

Figure 2:
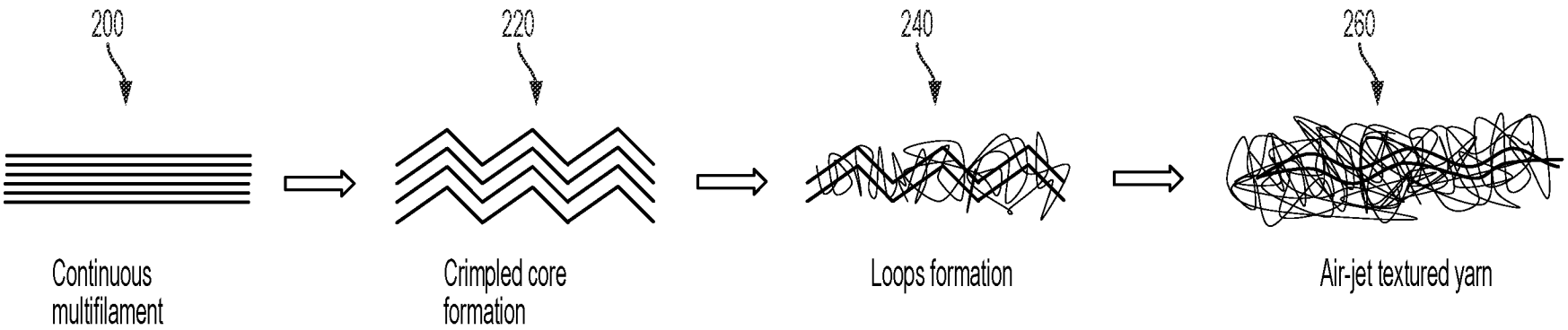
FIG. 2 is an illustration of the effect of texturization on physical properties of a plurality of wicking yarns in accordance with aspects of the invention.

FIG. 2 shows the process and effect texturization on the plurality of wicking yarns. The supply filament begins with continuous filament arrangements 200, which are crimped to form crimpled core fibers 220. The crimp of the fiber in the core component is determined by the core overfeed. The crimped core fibers 220 are entangled to form looped fibers 240, which are subject to the air pressure from a the jet nozzle to provide more entanglement of the fibers and provide the air-textured yarn 260.

The textured wicking yarns with inter-fiber voids can be created or enhanced in a non-wicking fiber using any suitable yarn bulking process such as the air-jet texturing process. For example, the air-jet texturing process is a mechanical yarn bulking process, which involves overfeeding a yarn by a supersonic air stream that develops loops and crimp. The air-jet texturizing process further entangles the fibers within the same bundle of the yarn, resulting in a uniform arrangement of synthetic continuous multi-filament yarns, each having inter fiber voids as a result of the texturizing process.

Inter-fiber voids are enhanced as a result of yarn bulking treatments, such as air-jet texturing. The inter-fiber voids can be formed in three different size scales: macro, meso, and micro. Micro-inter-fiber voids are formed between the fibers in a tow. Meso-inter-fiber voids are formed between the tows, and macro-inter-fiber voids are formed in a larger zone of the preform and are observable with the naked eye. Another term for macro-void is "dry spot." Other terms for meso-void are "inter-bundle'," "inter-tow," and "channel" void. Other terms for micro-void are "intra-bundle," "intra-tow'," and "tow" voids.

In some embodiments, a geotextile fabric includes a plurality of wicking yarns, each having a plurality of fibers with inter-fiber voids therebetween. The inter-fiber voids of the plurality of wicking yarns has a water flow of about 0.05 milliliters per day per denier (ml/day/denier) to about 1 milliliters per day per denier. For example, the plurality of wicking yarns has a water flow of about or in any range between 0.05, 0.08, 0.10, 0.15, 0.18, 0.20, 0.25, 0.30, 0.35, 0.40, 0.45, 0.50, 0.55, 0.60, 0.65. 0.70, 0.75, 0.80, 0.85, 0.90, 0.95, and 1.0 milliliters per day per denier.

In one or more embodiments, the plurality of fibers has a void ratio of about 0.8 to about 5. For example, the plurality fibers has the void ratio of about or in any range between 0.8, 1.0, 1.2, 1.4, 1.6, 1.8. 2.0. 2.2, 2.4, 2.5, 2.6, 2.8, 3.0, 3.2, 3.4, 3.6, 3.8, 4.0, 4.2, 4.4, 4.6, 4.8, and 5.0

In one or more embodiments, the inter-fiber voids are formed by texturizing or bulking in the fiber body resulting in the inter-fiber voids. For example, the inter-fiber voids are formed either during the manufacturing process of the fiber or yarn, or by a subsequent texturization of the manufactured yarn or fiber. Any suitable method for manufacturing or texturizing can be used to create inter-fiber voids of suitable size and void ratio.

Geotextile Fabric

In one or more embodiments, the geotextile fabric is a woven fabric, a nonwoven fabric, or a combination thereof. In some embodiments, the geotextile fabric is a nonwoven fabric. In some other embodiments, the geotextile fabric is a woven fabric.

In some embodiments, the geotextile fabric has a flow rate of about 2 liters per linear foot per day to about 20 liters per linear foot per day at zero gradient under load as measured by American Society for Testing and Materials (ASTM) 4716 method. In some other embodiments, the geotextile fabric has a flow rate of about 2 liters per linear foot per day to about 10 liters per linear foot per day at zero gradient under load as measured by American Society for Testing and Materials (ASTM) 4716 method. For example, in one or more embodiments, the geotextile fabric has a flow rate of about or in any range between 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, and 20 liters per linear foot per day at zero gradient under load as measured by American Society for Testing and Materials (ASTM) 4716 method.

In embodiments, the plurality of wicking yarns is disposed in a first axis of the geotextile fabric, and a polymeric yarn is disposed in a second axis of the fabric.

In one or more embodiments, the plurality of wicking yarns is arranged in the machine direction of the geotextile fabric, the cross machine direction, or both.

In one or more embodiments, a geotextile fabric made with the plurality of wicking yarns has a flow rate of at least 2 liters/linear foot per day. In one or more embodiments, the geotextile fabric made with the plurality of wicking yarns has a flow rate about or in any range between 2, 3, 4, 5, 6, 7, 8, 9, 10, 11, 12, 13, 14, 15, 16, 17, 18, 19, and 20 liters/linear foot per day. For example, the geotextile fabric with the plurality of wicking yarns has a flow rate of about 2 liters/linear foot per day to about 20 liters/linear foot per day, about 2 liters/linear foot per day to about 15 liters/linear foot per day, about 2 liters/linear foot per day to about 10 liters/linear foot per day, for example, about 2 liters/linear foot per day to about 9 liters/linear foot per day, about 2 liters/linear foot per day to about 7 liters/linear foot per day, about 2 liters/linear foot per day to about 6 liters/linear foot per day, about 2 liters/linear foot per day to about 5 liters/linear foot per day, about 2 liters/linear foot per day to about 4 liters/linear foot per day, and about 2 liters/linear foot per day to about 3 liters/linear foot per day.

The plurality of wicking yarns maintains unsaturated hydraulic conductivity in saturated and unsaturated environments. In some embodiments, each of the plurality of wicking yarns maintains unsaturated hydraulic conductivity in environments having a degree of saturation of less than 100%. For example, the plurality of wicking yarns of the geotextile remove moisture from a soil that has a saturation level less than about or in any range between 100%, 95%, 90%, 85%, 80%, 75%, 70%, 65%, 60%, 55%, 50%, 45%, 40%, 35%, 30%, 25%, 20%, 15%, 10%, 5%, 2% and 1%.

A method for making the geotextile fabric includes weaving the plurality of wicking yarns in an axis of the fabric. The method further includes texturizing a substantially round yarn to form each of the plurality of wicking yarns, each having a plurality of fibers with inter-fiber voids therebetween. In some embodiments, a method for making the geotextile fabric includes forming a nonwoven fabric from the plurality of wicking yarns, weaving a polymeric yarn in one axis of the geotextile fabric, and weaving the plurality of wicking yarns with the polymeric yarn in another axis of the fabric, each wicking yarn of the plurality of wicking yarns having a cross-sectional shape that is substantially round and including a plurality of fibers with inter-fiber voids therebetween. In some other embodiments, the method further includes air texturizing substantially round yarns to form the plurality of wicking yarns.

In embodiments, a geotextile fabric includes a plurality of texturized (or textured) fibers with inter-fiber voids therebetween; wherein the geotextile fabric has a water flow rate of at least 2 liters/linear foot per day. In one or more embodiments, the geotextile fabric made with the plurality of texturized fibers has a flow rate about or in any range between 2, 3, 4, 5, 6, 7, 8, 9, 10, 11, 12, 13, 14, 15, 16, 17, 18, 19, and 20 liters/linear foot per day. For example, the geotextile fabric with the plurality of texturized fibers has a flow rate of about 2 liters/linear foot per day to about 20 liters/linear foot per day, about 2 liters/linear foot per day to about 15 liters/linear foot per day, about 2 liters/linear foot per day to about 10 liters/linear foot per day, for example, about 2 liters/linear foot per day to about 9 liters/linear foot per day, about 2 liters/linear foot per day to about 7 liters/linear foot per day, about 2 liters/linear foot per day to about 6 liters/linear foot per day, about 2 liters/linear foot per day to about 5 liters/linear foot per day, about 2 liters/linear foot per day to about 4 liters/linear foot per day, and about 2 liters/linear foot per day to about 3 liters/linear foot per day.

In one or more embodiments, the plurality of texturized fibers has a void ratio of about 0.8 to about 5. For example, the plurality textured fibers have the void ratio of about or in any range between 0.8, 1.0, 1.2, 1.4, 1.6, 1.8. 2.0. 2.2, 2.4, 2.5, 2.6, 2.8, 3.0, 3.2, 3.4, 3.6, 3.8, 4.0, 4.2, 4.4, 4.6, 4.8, and 5.0

In one or more embodiments, the geotextile fabric is a woven fabric, a nonwoven fabric, or a combination thereof. In some embodiments, the geotextile fabric is a nonwoven fabric. In some other embodiments, the geotextile fabric is a woven fabric.

In some embodiments, a fabric made from the geotextile fabric has a flow rate of about 2 liters per linear foot per day to about 10 liters per linear foot per day at zero gradient under load as measured by American Society for Testing and Materials (ASTM) 4716 method. For example, in one or more embodiments, the fabric made from the geotextile fabric has a flow rate of about or in any range between 2, 2.5, 3, 3.5, 4, 4.5, 5, 5.5, 6, 6.5, 7, 7.5, 8, 8.5, 9, 9.5, and 10 liters per linear foot per day at zero gradient under load as measured by American Society for Testing and Materials (ASTM) 4716 method.

Weaves which can be employed in the present invention include, but are not limited to, plain, twills, specialty weaves, 3-D's, satins, sateens, honeycombs, lenos, baskets, oxfords, or panamas.

Wicking Drainage System

Figure 3:
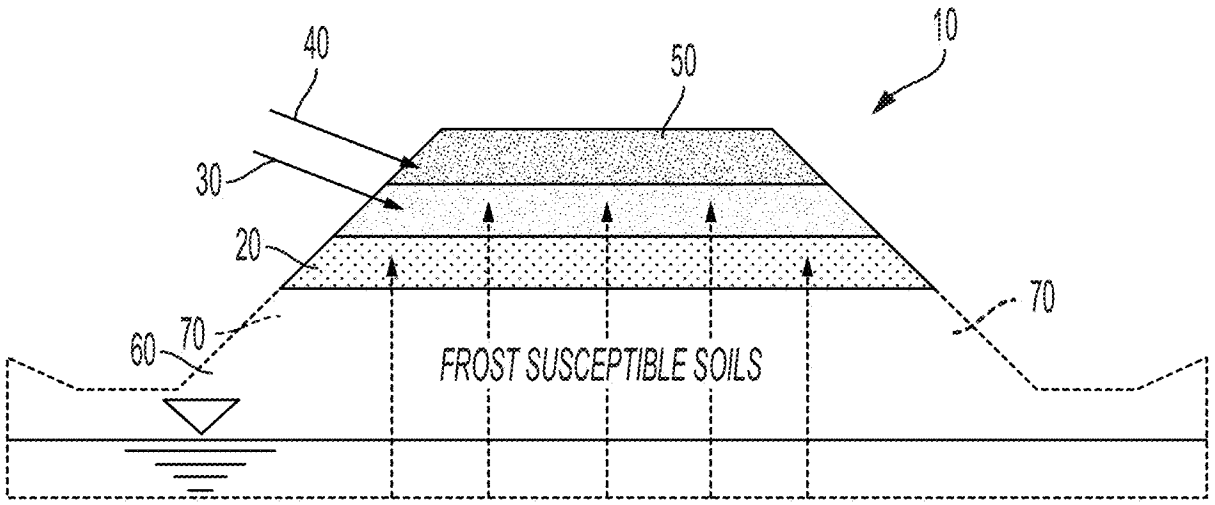
FIG. 3 is an illustration of a wicking drainage system in accordance with aspects of the present invention.

Referring to FIG. 3, in accordance with the present invention, a wicking drainage system 10 includes a geotextile fabric 20, a non-frost susceptible soil layer 30 disposed on/over the geotextile fabric 20, and a base layer 40, such as an asphalt treated base, disposed on the soil layer 30. Asphalt and/or concrete 50 are disposed on the base layer 40. The geotextile fabric 20 is disposed on a soil bed 60. The soil bed 60 is raised above the water table to form side drains 70 that facilitate water drainage. The thickness of the soil bed 60 is conventional. For example, the soil bed 60 can be 40 inches above the water table. Non-frost susceptible soil layer 30, such as one with 10% fines content, should be of a sufficient thickness as to allow water drainage from the base layer 40 to the geotextile fabric 20. In aspects of the present invention, the thickness of the non-frost susceptible soil layer 30 is about 13 inches. However, the thickness can be varied as necessary depending upon soil conditions.

In other aspects of the present invention, the wicking drainage system includes an impermeable hydrophobic geomembrane (not shown) disposed below the geotextile fabric 20. The geotextile fabric 20 allows water from the overlying soil to pass through the geotextile fabric 20 when the overlying soil is saturated and transport water laterally to side drains 70. When the overlying soil is unsaturated, the geotextile fabric can absorb water from the overlying unsaturated soil and transport it in the lateral directions. The impermeable hydrophobic geomembrane can repel water and completely cut off the capillary rise of ground water from beneath. In another aspect of the present invention, the geomembrane is a one-way-valve geotextile.

Figure 4:
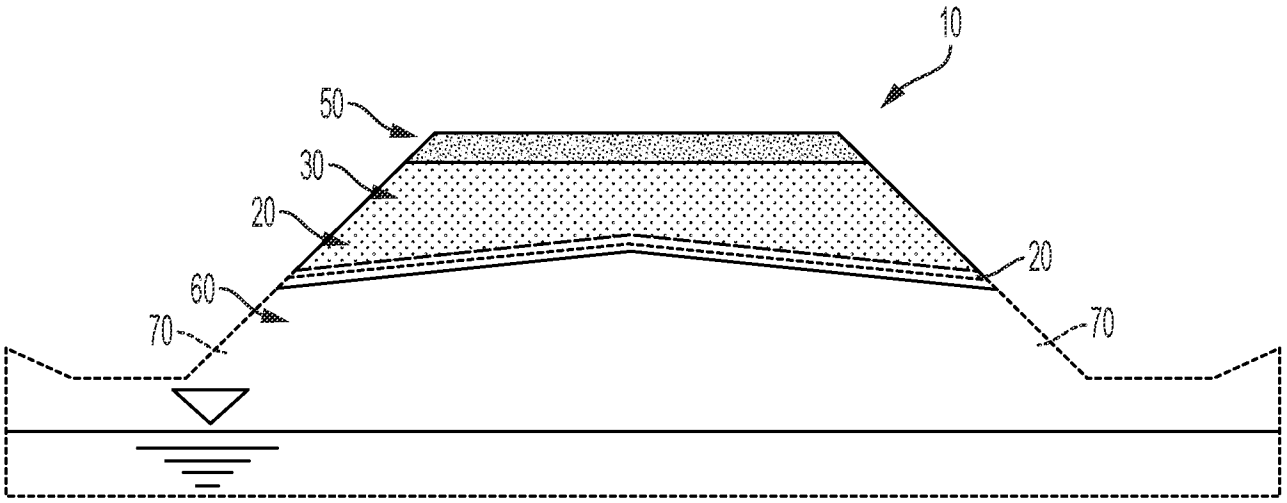
FIG. 4 is an illustration of a wicking drainage system in accordance with aspects the present invention.
Figure 5:
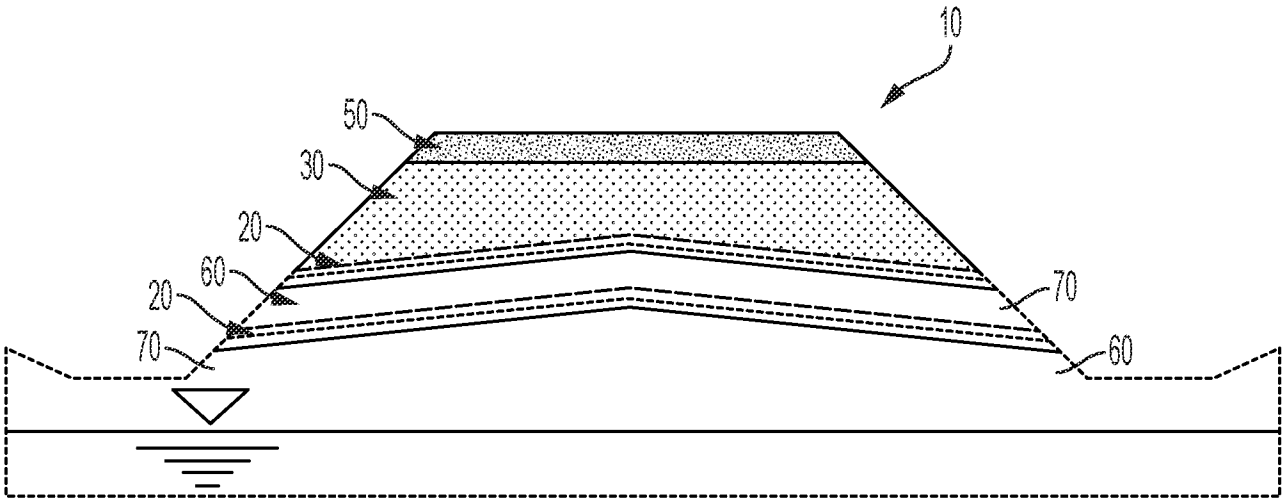
FIG. 5 is an illustration of a wicking drainage system in accordance with aspects of the present invention.
Figure 6:
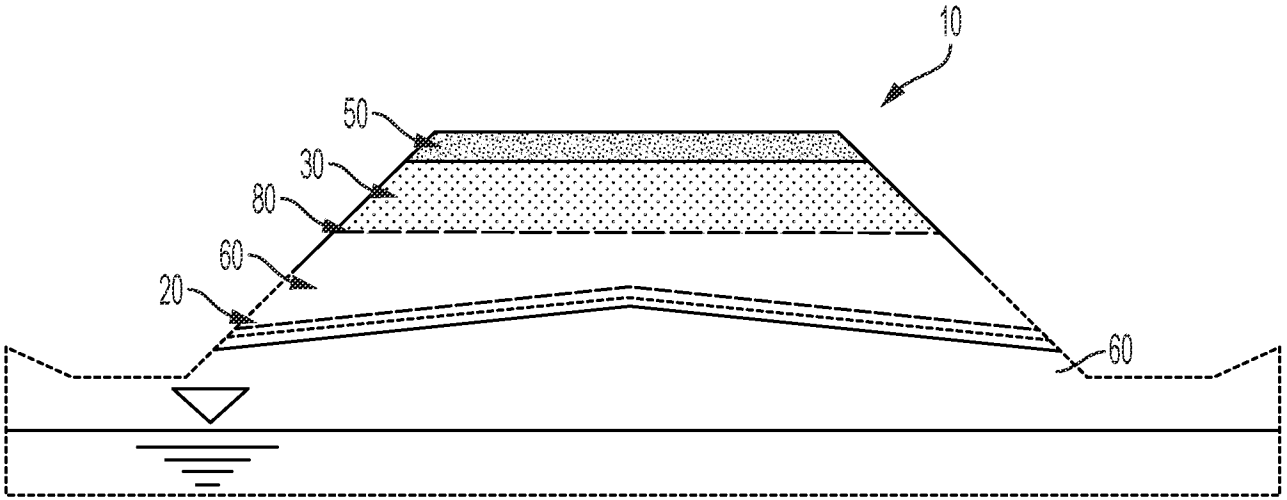
FIG. 6 is an illustration of a wicking drainage system in accordance with aspects of the present invention.

In an alternate design, the wicking drainage system includes the arrangements shown in FIGS. 4-6. When installed in a pavement structure, the geotextile fabric 20 is tilted at a slope from 5-10% so that infiltrating water will flow downwards. Furthermore, there should not be wrinkles of any significance that would cause water to pond on top of impermeable layer. FIG. 4 illustrates the wicking drainage system 10 of FIG. 3 with such a tilted arrangement.

As illustrated in FIG. 5, a second layer of geotextile fabric 20 is employed in the wicking drainage system 10. Disposed between the respective layers of geotextile fabrics 20 is a layer of the frost susceptible soil 60. In other aspects of the present invention, as illustrated in FIG. 6, the geotextile fabric 20 is disposed on a layer of frost susceptible soil 60. Further, another layer of frost susceptible soil 60 is disposed on the geotextile fabric 20. A geotextile separation layer 80 is disposed on the second layer of frost susceptible soil 60, and a layer of non-frost susceptible soil 30 is disposed on the geotextile separation layer 80.

The overall effect of the wicking drainage systems are to cut off upward capillary water flow and drain most of the infiltrated water out of the pavement structure through the tilted drainage net by the wicking geotextile fabric. The driving force for the water flow in the drainage net is gravity, and the driving forces for the water flow in the wicking fabric are gravity and suction generated by evaporation and freezing.

EXAMPLES

Table 1 shows properties of wicking yarns analyzed in the following examples.

TABLE 1

| Wicking yarns | | | | | | | | | | |
|---|---|---|---|---|---|---|---|---|---|---|
| ID | Material | Contact Angle, θ (°) | Surface tension with water τ (mJ/m$^2$) | τ*cos(θ) | Shape | No. of filaments | Denier per filament (g/9 km) | Denier (g/9 km) | Additional comments | Inventive/ comparative |
| 1 | PP | 102 | 30 | −6.24 | Delta | 216 | 5 | 1140 | High air texturize | Inventive |
| 2 | PP | 102 | 30 | −6.24 | Delta | 144 | 4 | 600 | No air texturize | Comparative |
| 3 | Nylon | 68 | 46.5 | 17.42 | 4DG | 566 | 6 | 3400 | No twist, No air texturize | Comparative |
| 4 | Nylon | 68 | 46.5 | 17.42 | 4DG | 144 | 6 | 865 | 1.5 turns/inch, No air texturize | Comparative |
| 5 | PET | 72 | 44.6 | 13.78 | Round | 288 | 6.25 | 1800 | Ultra-high air texturize | Inventive |
| 6 | PET | 72 | 44.6 | 13.78 | Delta | 325 | 4 | 1300 | No air texturize | Comparative |
| 7 | PET | 72 | 44.6 | 13.78 | Round | 192 | 5 | 1000 | No air texturize | Comparative |
| 8 | PET | 72 | 44.6 | 13.78 | Round | 192 | 5 | 1000 | High air texturize | Inventive |

TABLE 1-continued

| Wicking yarns | | | | | | | | | | |
|---|---|---|---|---|---|---|---|---|---|---|
| ID | Material | Contact Angle, θ (°) | Surface tension with water τ (mJ/m$^2$) | τ*cos(θ) | Shape | No. of filaments | Denier per filament (g/9 km) | Denier (g/9 km) | Additional comments | Inventive/ comparative |
| 9 | PET | 72 | 44.6 | 13.78 | Round | 384 | 5 | 2000 | High air texturize | Inventive |
| 10 | Nylon | 68 | 46.5 | 17.42 | 4DG | 144 | 6 | 865 | Air texturize | Inventive |
| 11 | PET | 72 | 44.6 | 13.78 | Round | 100 | 10 | 1000 | High air texturize | Inventive |

Example 1: Non-Normalized Data Capillary Rise Test

Figure 7:
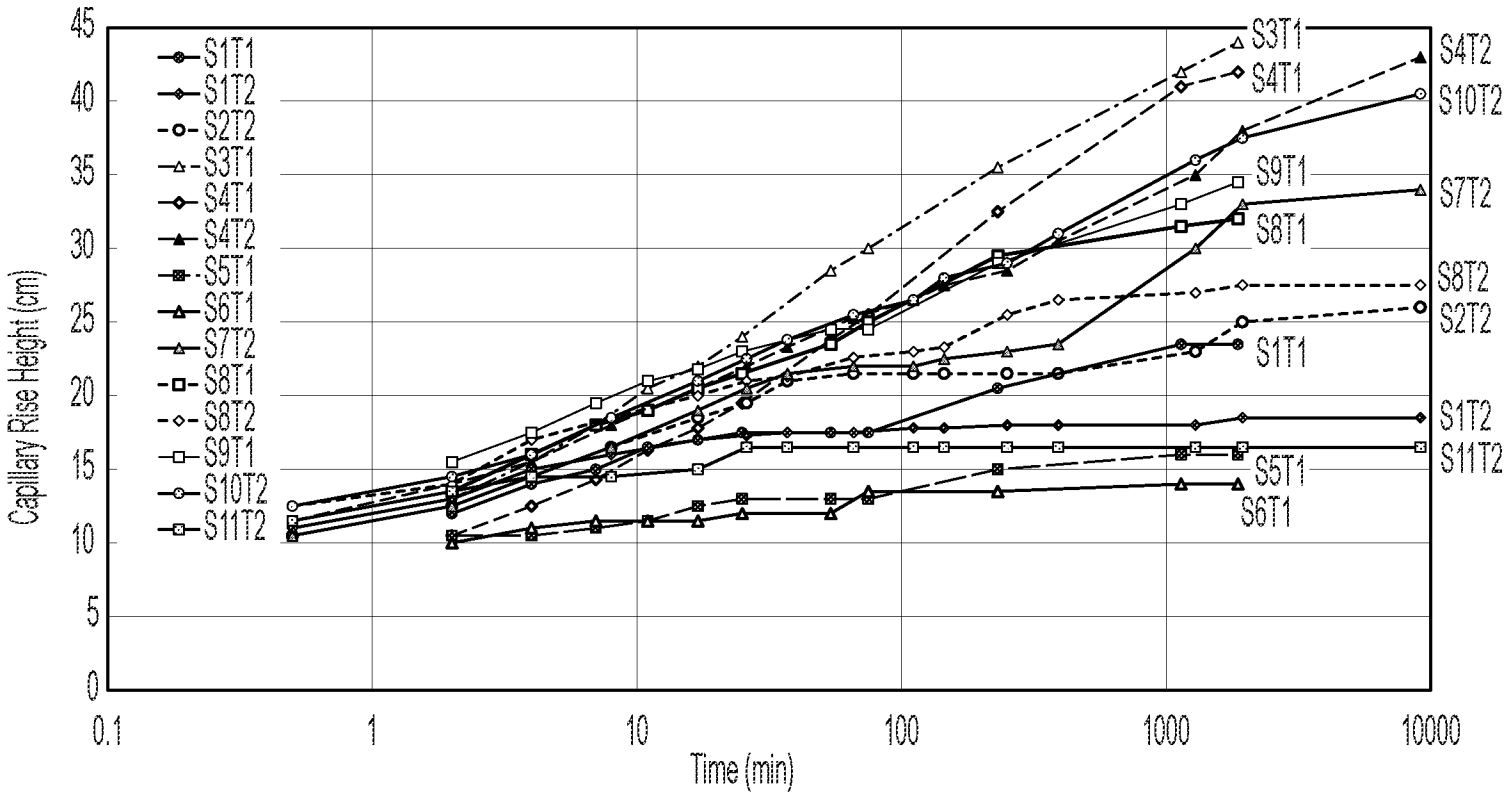
FIG. 7 is a graph showing non-normalized raw data capillary test results for various fabrics.

Table 2 and FIG. 7 show the results of non-normalized raw data capillary rise tests for samples 1 to 11 from Table 1. Samples 1-13 were tested for up to 1000 to 10000 minutes. The capillary rise test measures the rise in a liquid above the level of zero pressure due to a net upward force produced by the attraction of the water molecules to a solid surface (e.g., fiber, soil, glass, etc.).

The capillary rise height is measured by Lucas-Washburn equation, $$\rho\pi R^2 \frac{d}{dt}\left(h\frac{dh}{dt}\right) = 2\left[\ \right]R\sigma\cos(\theta) - \left[\ \right]R^2\rho gh - 8\left[\ \right]\mu h\frac{dh}{dt}$$

where,
h is height of water at time t
R is capillary tube radius
μ is liquid viscosity
σ is surface tension
θ is contact angle at liquid/solid, and
ρ is the liquid density.

As shown in FIG. 7 and Table 2, air-textured yarns, samples S1T1, S8T1, S8T2, S9T1, S10T1, and S10T2, showed better capillary height compared to non-texturized samples S2T2, S3T1, S4T1, S6T1, and S7T1. Ultra-high air-texturized sample S5T1 did not perform any better than non-texturized sample S6T1. Table 2 shows that apart from texturization, which helps in improving inter-fiber voids, the cross-sectional shape of the fiber also plays a role in results of the capillary rise test. For example, the non-texturized 4DG shape samples, S3T1 and S4T1, performed as well as texturized 4DG shaped sample S10T2. Denier per filament (dpf) can also have an impact on wicking properties of yarns, as more denier per filament means more fibers that can transport water. However, the amount of voids and the distances of the voids between the fibers have much greater impact on wicking properties than just denier per filament.

Example 2: Horizontal Flow Comparison Test-1

Figure 8:
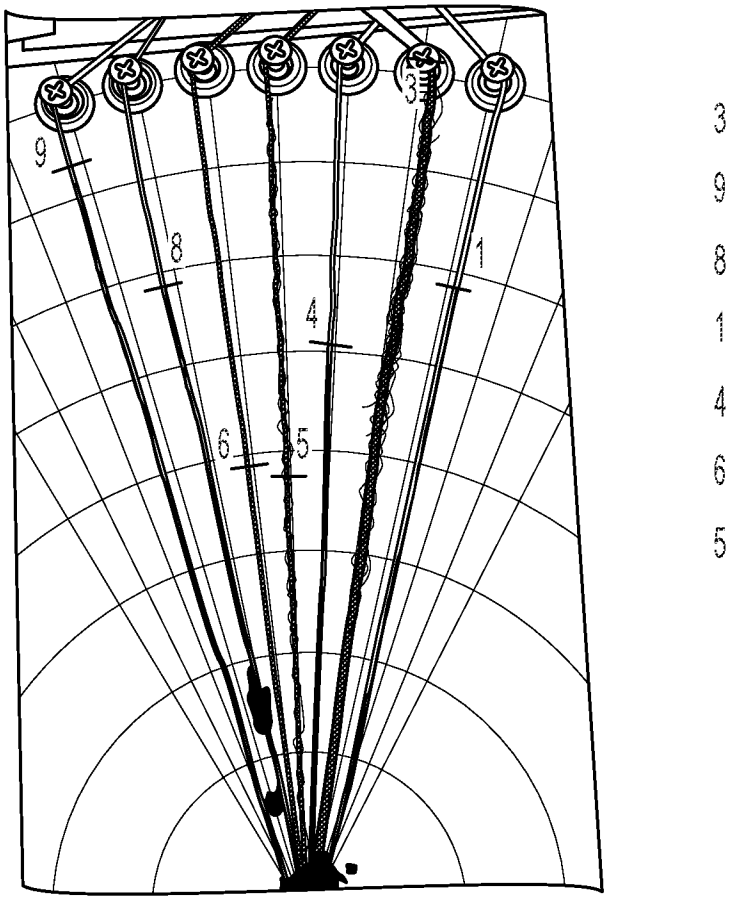
FIG. 8 shows a horizontal flow comparison-1 result for a geosynthetic fabric.

Table 3 and FIG. 8 show the results for horizontal flow comparison test-1 for samples 1, 3-6, 8, and 9 (from Table 1). The horizontal flow comparison test is a visual test used to determine orders of yarns based on the distance water moves in a fixed amount of time. The data from Table 3

TABLE 2

| Non-normalized raw data capillary rise test for samples 1-11 | | | | | | | |
|---|---|---|---|---|---|---|---|
| ID | Mat. | Shape | # of filaments | D.P.F (g/9 km) | Denier (g/ 9 km) | Capillary rise height (cm) | Additional comments |
| S1T1 | PP | Delta | 216 | 5 | 1140 | B | High A.T. |
| S1T2 | PP | Delta | 216 | 5 | 1140 | A | High A.T. |
| S2T2 | PP | Delta | 144 | 4 | 600 | C | No A T. |
| S3T1 | Nylon | 4DG | 566 | 6 | 3400 | D | No twist, No A.T. |
| S4T1 | Nylon | 4DG | 144 | 6 | 865 | D | 1.5 turns/in., No A.T. |
| S4T2 | Nylon | 4DG | 144 | 6 | 865 | D | 1.5 turns/in., No A.T. |
| S5T1 | PET | Round | 288 | 6.25 | 1800 | A | Ultra-high A.T. |
| S6T1 | PET | Delta | 325 | 4 | 1300 | A | No A.T. |
| S7T1 | PET | Round | 192 | 5 | 1000 | C | No A.T. |
| S8T1 | PET | Round | 192 | 5 | 1000 | C | High A.T. |
| S8T2 | PET | Round | 192 | 5 | 1000 | C | High A.T. |
| S9T1 | PET | Round | 384 | 5 | 2000 | C | High A.T. |
| S10T2 | Nylon | 4DG | 144 | 6 | 865 | D | A.T. |
| S11T2 | PET | Round | 100 | 10 | 1000 | A | High A.T. |

"A.T." stands for air texturized
A: <20 cm,
B: 20-25 cm,
C: 26-35 cm,
D: >35 cm illustrates that air textured yarns, samples 1, 8, and 9, performed better than non-textured yarns, samples 4 and 6. The ultra-high air-texturized yarn sample 5 performed worst in this test, illustrating that there is an optimum void-ratio for inter-fiber voids, and voids that are too small (samples 4 and 6) or too large (sample 5) are detrimental for wicking properties of wicking yarns.

Comparison of samples 5, 8, and 9 demonstrated the effect of texturization on inter-fiber voids and wicking properties of round-shaped wicking yarns. High air-texturized samples 8 and 9 showed improved wicking performance compared to the ultra-high air-texturized sample 5, again demonstrating there is an optimum range for a void ratio.

TABLE 3

Non-normalized raw data test for samples 1, 3-6, 8, and 9 to determine which yarn moved water in their respective orders.

| ID | Mat. | Shape | # of filaments | D.P.F (g/9 km) | Denier (g/9 km) | Horizontal flow rank | Additional comments |
|---|---|---|---|---|---|---|---|
| 1 | PP | Delta | 216 | 5 | 1140 | D | High A.T. |
| 3 | Nylon | 4DG | 566 | 6 | 3400 | A | No twist, No A.T. |
| 4 | Nylon | 4DG | 144 | 6 | 865 | E | 1.5 turns/in., No A.T. |
| 5 | PET | Round | 288 | 6.25 | 1800 | G | Ultra-high A.T. |
| 6 | PET | Delta | 325 | 4 | 1300 | F | No A.T. |
| 8 | PET | Round | 192 | 5 | 1000 | C | High A.T. |
| 9 | PET | Round | 384 | 5 | 2000 | B | High A.T. |

A: 1st,
B: 2nd,
C: 3rd,
D: 4th,
E: 5th,
F: 6th,
G: 7th

Example 3: Horizontal Flow Comparison Test-2

Figure 9:
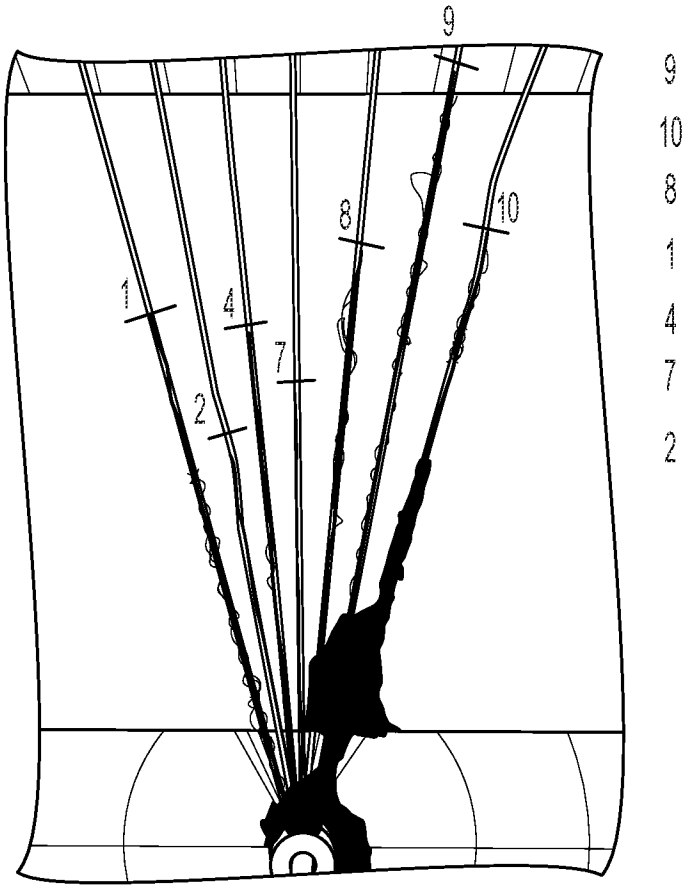
FIG. 9 shows a horizontal flow comparison-2 result for a geosynthetic fabric.

Table 4 and FIG. 9 show the results for horizontal flow comparison test-2 for samples 1, 2, 4, and 7 to 10.

TABLE 4

Non-normalized raw data capillary rise test results for samples 1, 2, 4, and 7 to 10

| ID | Mat. | Shape | # of filaments | D.P.F (g/9 km) | Denier g/9 km) | Horizontal flow rank | Additional comments |
|---|---|---|---|---|---|---|---|
| 1 | PP | Delta | 216 | 5 | 1140 | D | High A.T. |
| 2 | PP | Delta | 144 | 4 | 600 | G | No A.T. |
| 4 | Nylon | 4DG | 144 | 6 | 865 | E | 1.5 turns/in., No A.T. |
| 7 | PET | Round | 192 | 5 | 1000 | F | No A.T. |
| 8 | PET | Round | 192 | 5 | 1000 | C | High A.T. |
| 9 | PET | Round | 384 | 5 | 2000 | A | High A.T. |
| 10 | Nylon | 4DG | 144 | 6 | 865 | B | A.T. |

A: 1st,
B: 2nd,
C: 3rd,
D: 4th,
E: 5th,
F: 6th,
G: 7th

Similar to Example 2, in Example 3 (Table 4 and FIG. 9), air-texturized samples 1, 8, 9, and 10 showed improved wicking performance compared to non-texturized samples 2, 4, and 7. Comparison of samples 4 and 10, both having 4DG shape and made of nylon material, demonstrates the effect of texturization or presence of an optimum void ratio on wicking performance. In Table 2, for the capillary rise height test, non-texturized 4DG shaped samples, S3T1 and S4T1, performed as well as texturized 4DG shape sample 510T2. However, as shown in Table 4, for the horizontal flow test, non-texturized sample 4 was ranked lower than texturized sample 10, with the same shape and material, demonstrating the effect of having optimum inter-fiber voids due to texturization or otherwise.

Example 4: Horizontal Flow Comparison Test-3

Figure 10:
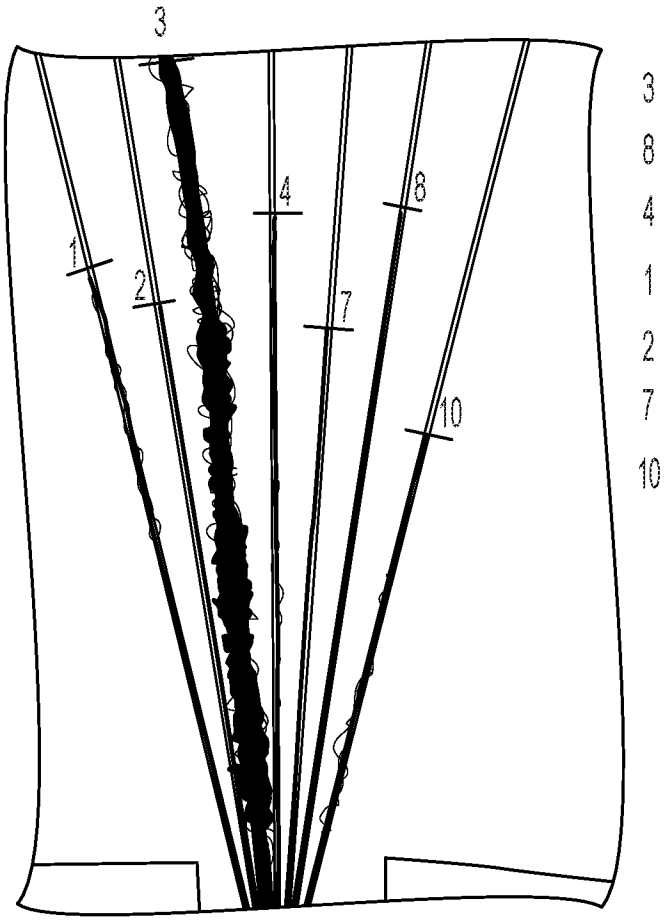
FIG. 10 shows a horizontal flow comparison-3 result for a geosynthetic fabric.

Table 5 and FIG. 10 show the results for horizontal flow comparison test-3 for samples 1 to 4, 7, 8, and 10.

TABLE 5

Non-normalized raw data capillary rise test results for samples 1 to 4, 7, 8, and 10.

| ID | Mat. | Shape | # of filaments | D.P.F (g/9 km) | Denier (g/9 km) | Horizontal flow rank | Additional comments |
|---|---|---|---|---|---|---|---|
| 1 | PP | Delta | 216 | 5 | 1140 | D | High A.T. |
| 2 | PP | Delta | 144 | 4 | 600 | E | No A.T. |
| 3 | Nylon | 4DG | 566 | 6 | 3400 | A | No twist, No A.T. |
| 4 | Nylon | 4DG | 144 | 6 | 865 | C | 1.5 turns/in., No A.T. |
| 7 | PET | Round | 192 | 5 | 1000 | F | No A.T. |
| 8 | PET | Round | 192 | 5 | 1000 | B | High A.T. |
| 10 | Nylon | 4DG | 144 | 6 | 865 | G | A.T. |

A: 1st,
B: 2nd,
C: 3rd,
D: 4th,
E: 5th,
F: 6th,
G: 7th

Similar to Examples 2 and 3, in Example 4 (Table 5 and FIG. 10), air-texturized samples 1, 8, and 10 showed improved wicking performance compared to non-texturized samples 2, 4, and 7. Sample 3 is about 3.5 times larger in denier than samples 1 and 10, and as mentioned in Example 1, denier size can also have an effect on wicking performance, as a larger denier size means a larger fiber.

Example 5: Horizontal Flow Comparison Test-4

Figure 11:
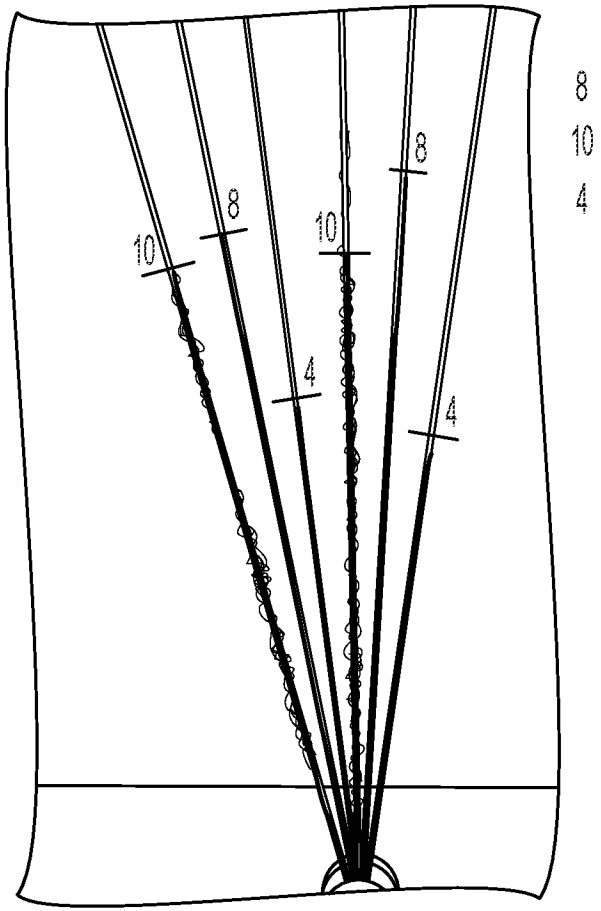
FIG. 11 shows a horizontal flow comparison-4 result for a geosynthetic fabric.

Table 6 and FIG. 11 show the results for horizontal flow comparison test-4 for samples 4, 8, and 10.

TABLE 6

Non-normalized raw data capillary rise test results for samples 4, 8, and 10.

| ID | Mat. | Shape | # of filaments | D.P.F (g/9 km) | Denier (g/9 km) | Horizontal flow rank | Additional comments |
|---|---|---|---|---|---|---|---|
| 4-1 | Nylon | 4DG | 144 | 6 | 865 | C | 1.5 turns/in., No A.T. |
| 4-2 | Nylon | 4DG | 144 | 6 | 865 | C | 1.5 turns/in., No A.T. |
| 8-1 | PET | Round | 192 | 5 | 1000 | A | High A.T. |
| 8-2 | PET | Round | 192 | 5 | 1000 | A | High A.T. |
| 10-1 | Nylon | 4DG | 144 | 6 | 865 | B | A.T. |
| 10-2 | Nylon | 4DG | 144 | 6 | 865 | B | A.T. |

A: 1st,
B: 2nd,
C: 3rd

Similar to Examples 2-4, in Example 5 (Table 6 and FIG. 11), air-texturized samples 8-1, 8-2, 10-1, and 10-2 showed improved wicking performance compared to non-texturized samples 4-1 and 4-2.

Examples 2-5 thus illustrate that wicking yarns with an optimum level of inter-fiber voids (either by texturization by using air-texturization, or otherwise) perform better compared to wicking yarns with an insufficient number of small voids, or large inter-fiber voids that are too far apart in distance relative to other fibers.

Example 6: Box Test

Figure 12:
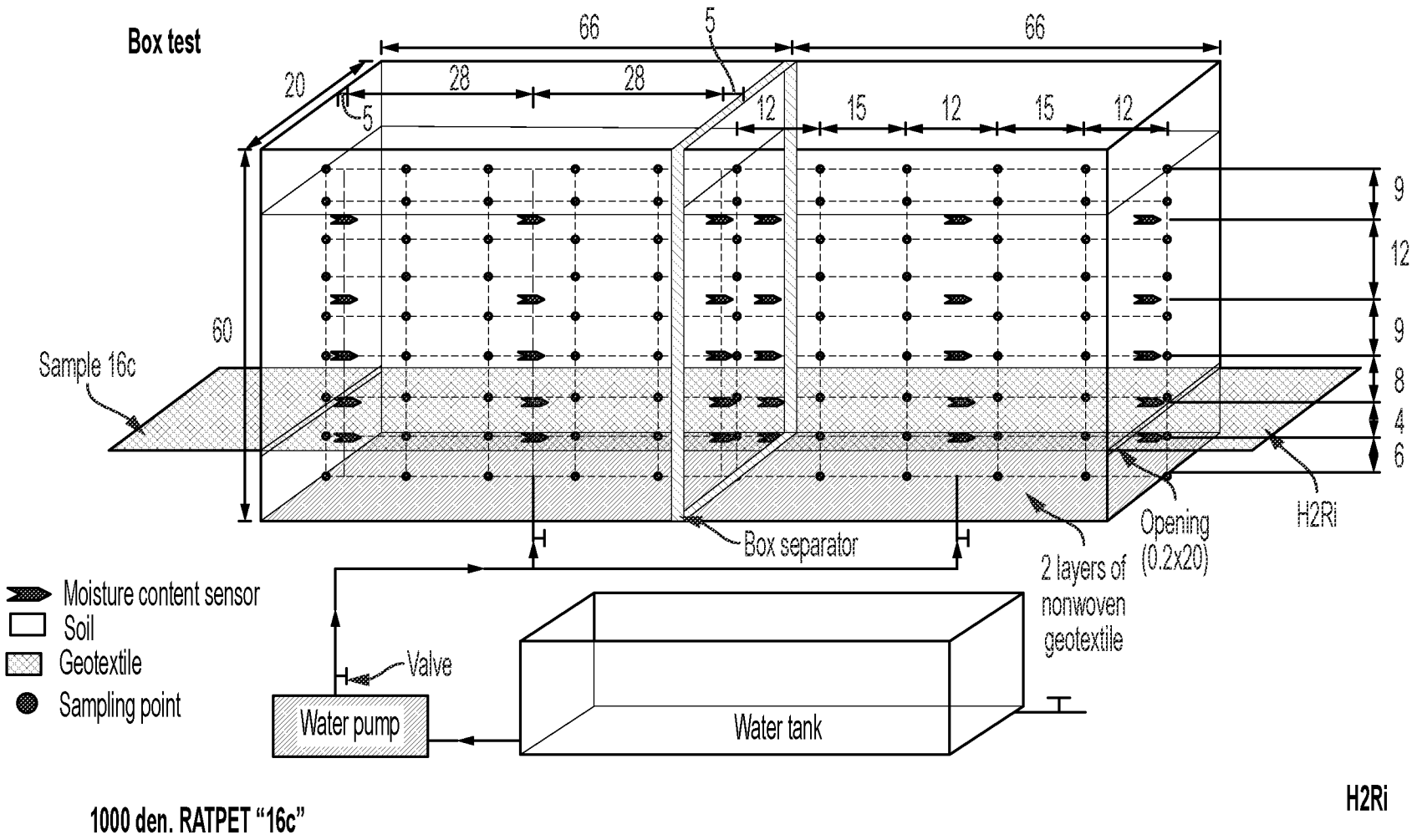
FIG. 12 is an illustration of a box test.

FIG. 12 shows a schematic representations of a box test. The box test measures the effectiveness of the geotextile in transporting water horizontally to the exposed end of the geotextile where it can evaporate. The box consists of two separate transparent containers and can be used to do two different tests at the same time. Each container is 66 centimeter (cm) long, 20 cm wide and 60 cm high. At the height of 10 cm above the bottom of the box at the far side of each container, a 2 millimeter (mm) opening along the entire width of the box is cut. A geotextile is placed horizontally at the height of the opening and is extended through the opening, allowing water to evaporate from the extended surface of the geotextile. At predetermined locations in each container, sensors are placed to monitor volumetric water content throughout the test.

Figure 13:
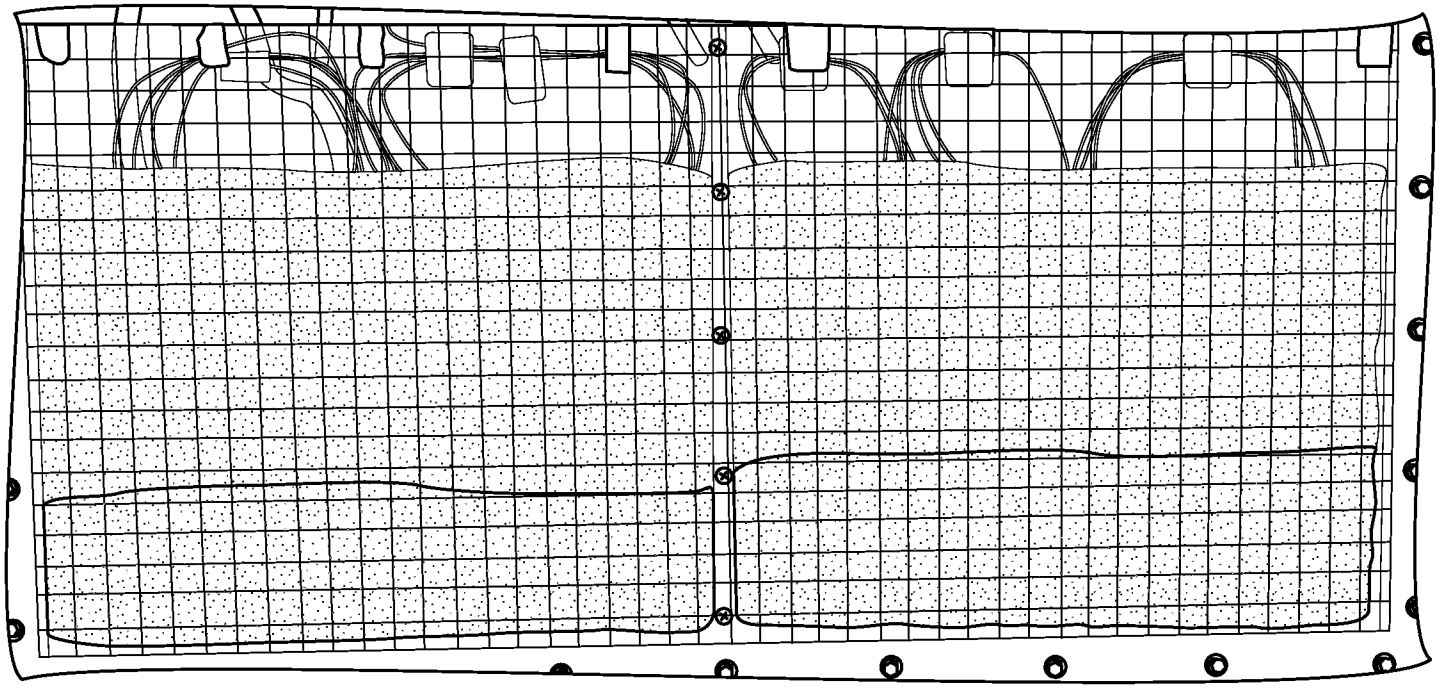
FIG. 13 shows a box test setup for a geotextile containing 1000 denier round air-texturized polyester RATPET fabric sample made from yarn sample 8, in accordance with aspects of the invention (right), and a comparative H2Ri fabric, a fabric that contains a non round non texturized (or textured) nylon yarn (left).

As shown in FIG. 13, in the box test, 10000 denier RATPET (right), performed better than H2Ri sample (left), and extracted 28% more water from a uniformly graded sand.

Example 7: Flow Rate Test

Figure 14:
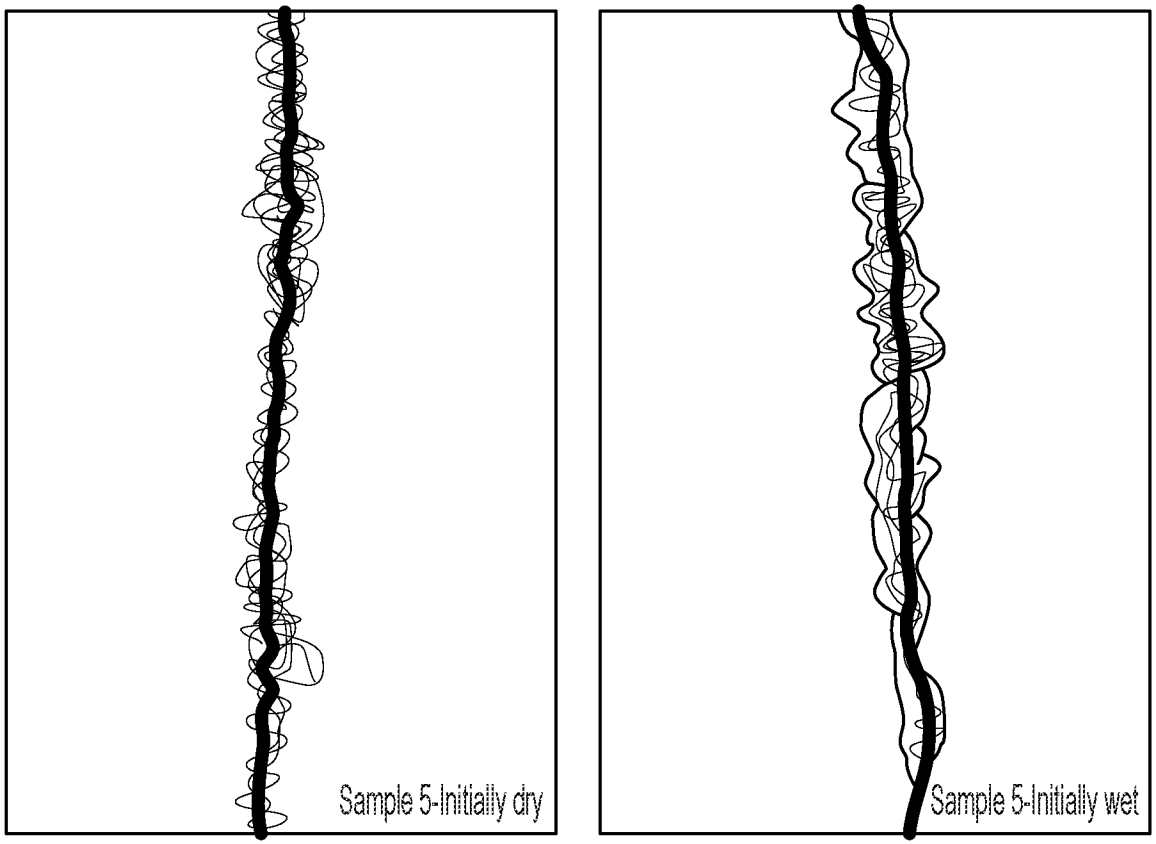
FIG. 14 is an illustration of a flow rate test.
Figure 14:
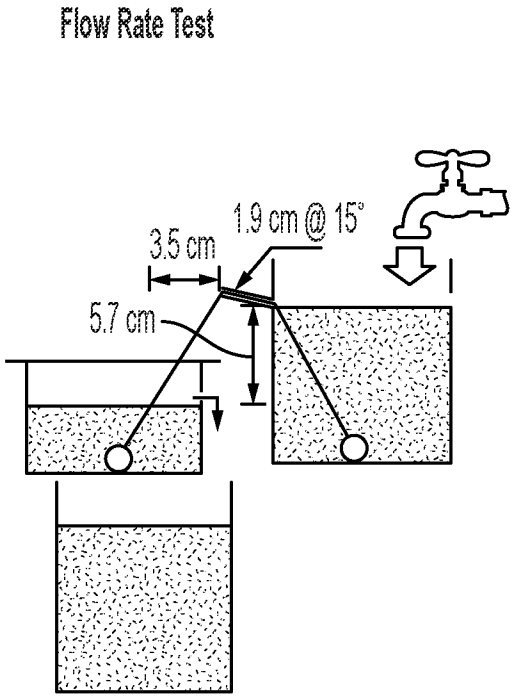

FIG. 14 shows schematic representation of the flow rate test (left), and flow rate test results for sample 5 (center and right). The flow rate test is an adaptation of ASTM D 2434 "Standard test method for permeability of granular soil," in which water flow rate is calculated when the hydraulic head does not vary with time at any location in the specimen. In this test, different hydraulic heads are applied at two points on the fiber. Due to the difference in the applied heads (5.7 cm), water flows from the larger head to the smaller one. Collecting the amount of water flowing over a time period provides the water flow rate in the fiber.

Table 7 shows the flow rate test results for various fibers. The data from Table 7 shows that air texturizing increased the yarn's performance in flow rate test, especially when the yarn was initially wet, indicating the average inter-fiber void spaces or inter-fiber voids was increased (except for sample 5 with ultra-high texturizing).

TABLE 7

Flow rate test results

| No. | ID | Denier (g/9 km) | Number of yarns | Time (min) | Water mass (ml) | Flow rate (ml/min) per yarn | Flow rate per yarn normalized with denier (ml/(min*Denier)) | Initial Condition |
|---|---|---|---|---|---|---|---|---|
| 1 | 5 | 1800 | 1 | 7 | 13.68 | 1.954 | 1.09E−03 | Wet |
| 2 | 5 | 1800 | 2 | 4 | 13.91 | 1.739 | 9.66E−04 | Wet |
| 3 | 1 | 1140 | 1 | 4 | 2.69 | 0.673 | 5.90E−04 | Wet |
| 4 | 9 | 2000 | 1 | 62 | 27.60 | 0.445 | 2.23E−04 | — |
| 5 | 3 | 3400 | 1 | 11 | 7.74 | 0.704 | 2.07E−04 | Wet |
| 6 | 3 | 3400 | 1 | 40 | 22.11 | 0.553 | 1.63E−04 | — |
| 7 | 3 | 3400 | 1 | 20 | 8.02 | 0.401 | 1.18E−04 | Dry |
| 8 | 4 | 865 | 1 | 13 | 1.32 | 0.102 | 1.17E−04 | Wet |
| 9 | 9 | 2000 | 1 | 25 | 5.60 | 0.224 | 1.12E−04 | Wet |
| 10 | 4 | 865 | 6 | 20 | 8.74 | 0.073 | 8.42E−05 | — |
| 11 | 10 | 865 | 1 | 36 | 1.84 | 0.051 | 5.91E−05 | Wet |
| 12 | 11 | 1000 | 1 | 82 | 3.85 | 0.047 | 4.70E−05 | Wet |
| 13 | 8 | 1000 | 1 | 54 | 2.50 | 0.046 | 4.63E−05 | Wet |
| 14 | 1 | 1140 | 1 | 33 | 1.71 | 0.052 | 4.55E−05 | Dry |
| 15 | 1 | 1140 | 1 | 420 | 20.54 | 0.049 | 4.29E−05 | — |
| 16 | 8 | 1000 | 1 | 630 | 26.68 | 0.042 | 4.23E−05 | — |
| 17 | 4 | 865 | 1 | 38 | 0.92 | 0.024 | 2.80E−05 | Dry |
| 18 | 9 | 2000 | 1 | 32 | 1.70 | 0.053 | 2.66E−05 | Dry |
| 19 | 8 | 1000 | 1 | 165 | 3.60 | 0.022 | 2.18E−05 | — |
| 20 | 10 | 865 | 1 | 35 | 0.63 | 0.018 | 2.08E−05 | Wet |
| 21 | 6 | 1300 | 1 | 66 | 1.70 | 0.026 | 1.98E−05 | Wet |
| 22 | 10 | 865 | 1 | 213 | 3.19 | 0.015 | 1.73E−05 | Dry |
| 23 | 10 | 865 | 1 | 64 | 0.95 | 0.015 | 1.72E−05 | Dry |
| 24 | 10 | 865 | 1 | 744 | 9.26 | 0.012 | 1.44E−05 | Wet |
| 25 | 8 | 1000 | 1 | 104 | 1.39 | 0.013 | 1.34E−05 | Dry |
| 26 | 11 | 1000 | 1 | 247 | 3.28 | 0.013 | 1.33E−05 | Dry |
| 27 | 7 | 1000 | 1 | 92 | 0.73 | 0.008 | 7.93E−06 | Wet |
| 28 | 4 | 865 | 1 | 720 | 4.69 | 0.007 | 7.53E−06 | — |
| 29 | 7 | 1000 | 1 | 77 | 0.56 | 0.007 | 7.27E−06 | Dry |
| 30 | 5 | 1800 | 1 | 240 | 1.29 | 0.005 | 2.99E−06 | Dry |
| 31 | 2 | 600 | 1 | 287 | 0.26 | 0.001 | 1.51E−06 | Dry |

Test results from Table 7 indicate that variability of test results for 4DG filaments nylon yarns. Samples 3 (entries 5-7), 4 (entries 8, 10, 17, and 28), and 10 (entries 11, 20, and 22-24) were generally higher than other yarns. Polypropylene (PP) samples 1 (entries 3, 14, and 15) and 2 (entry 31) performed the worst in both the flow rate and capillary rise tests (as shown in Table 2). It is also clear from Table 7 that increasing the number of the filaments increases the flow rate exponentially (entries 1 and 2; and 8 and 10).

Delta shaped filaments (samples 1, 2, and 6 (entry 21)) performed poorly in both capillary rise (Table 2) and flow rate test (Table 7). Table 7 also illustrates that the air texturizing is more impactful on flow rate than the type of polymer, filament count, and shape by itself. Samples 8 (entries 13, 16, 19, and 25) and 9 (entries 4, 9, and 18) showed improved performance compared to sample 7 (entries 27 and 29), and all three of samples 7, 8, and 9 include PET material, have a round shape, the same filament count, except that samples 8 and 9 are high air-texturized, whereas sample 7 is non-texturized.

Table 7 also illustrates that increasing denier per filament (dpf) decreases water transportability by increasing the inter-filament void spaces. 4DG filaments (samples 3, 4, and 10) have very small inner-fiber voids and thus perform the best in capillary rise tests (Table 2). However, the volume of water these channels move is very small when compared to the difference that results from air texturizing, as shown by samples 3, 4, and 10 from Table 7.

Figure 15:
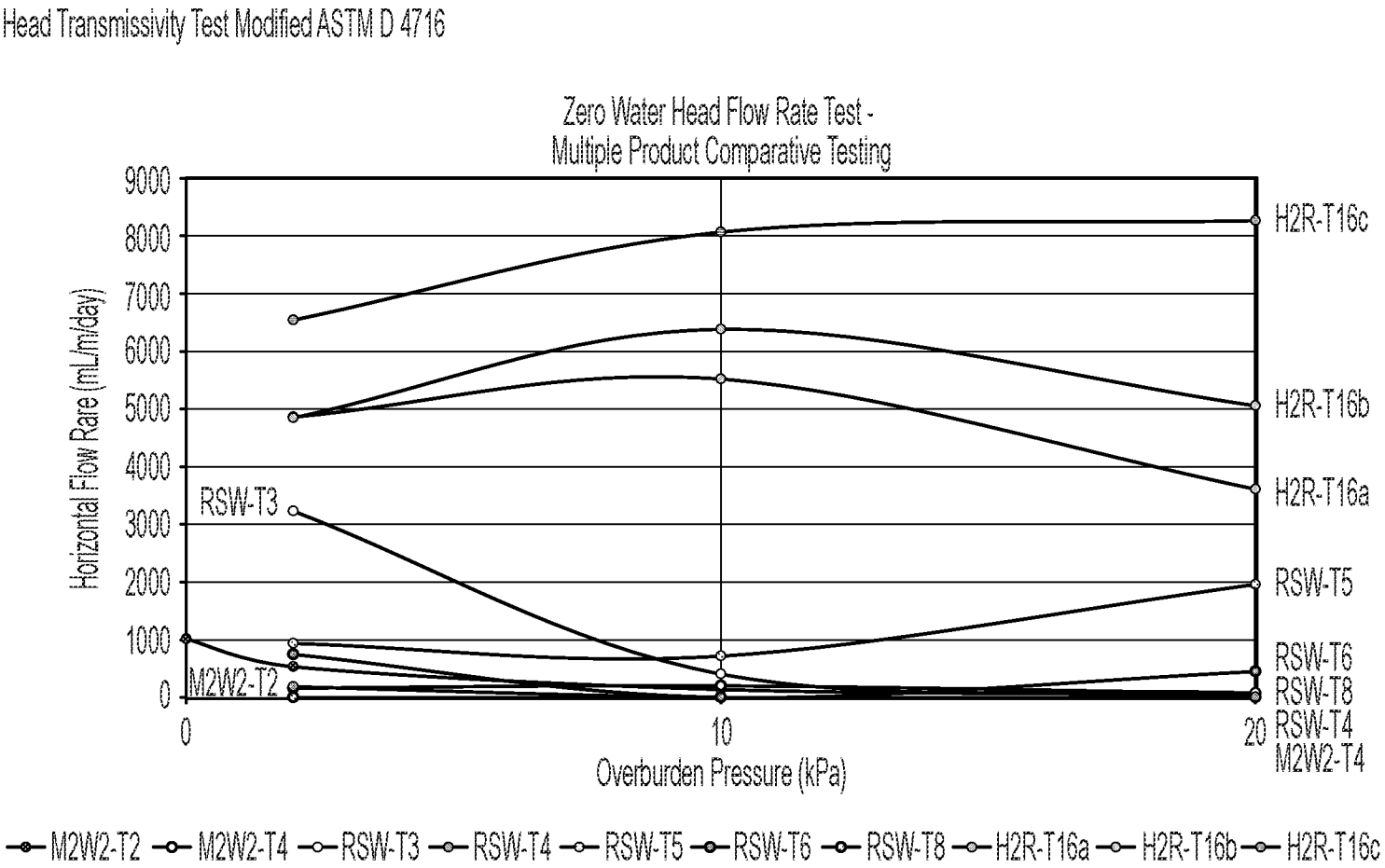
FIG. 15 is a graph showing zero water head transmissivity test results for multiple product comparative testing using the modified ASTM D 4716 method.

FIG. 15 is a graph of horizontal flow rate in milliliters per meter per day (mL/m/day) versus overburden pressure in kilopascal (kPa). The graph shows the zero-gradient data for multiple product comparative testing using a modified ASTM D 4716 test. Pressures from 0 kPa to up to 20 kPa were used. As shown in FIG. 15, air-texturized round PET sample H2R-T16c performed better than non-texturized samples containing trilobal PET wicking fibers M2W2-T2, M2W2-T4, RSW-T3, RSW-T4, RSW-T5, RSW-T6, and RSW-T8, illustrating the effect of presence of an optimal sized inter-fiber voids on wicking properties of a fiber.

FIG. 15 also shows the effect of the amount of texturizing. Sample H2R-T16a had the least amount of texturizing as a function of the amount of air pressure, and H2R-T16b had more dwell time in the air texturizing chamber than H2R-T16a but less than sample H2R-T16c. These results also provided optimal process parameters for making the inter-fiber voids. The inter-fiber voids in sample H2R-T16c can be considered as an optimal set point. Greater dwell in the texturizing chamber or mechanical entanglement after the optimal set point of H2R-T16c resulted in lower flow rates.

Figure 16:
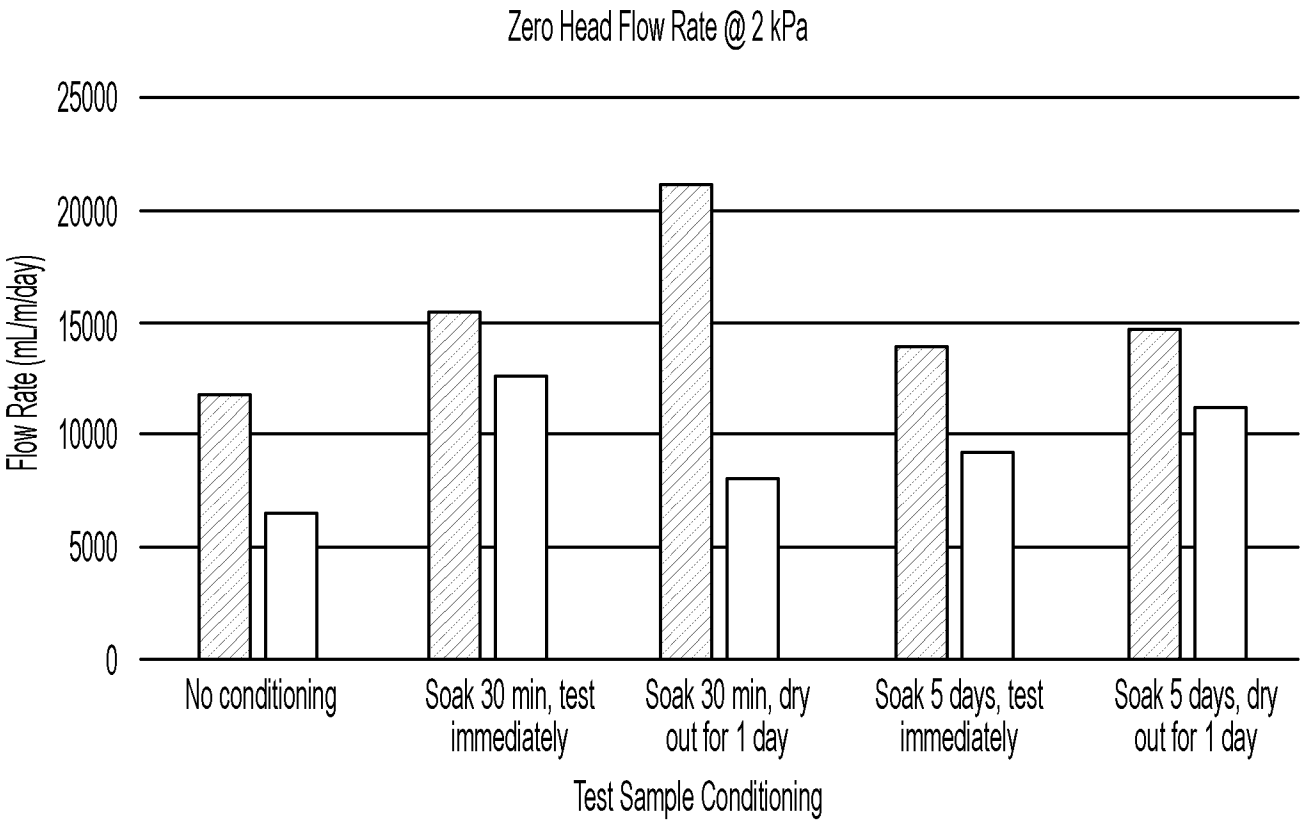
FIG. 16 is graph comparing zero head flow rate (at 2 kilopascal (kPa) of various samples over time.

FIG. 16 shows the comparison of zero head flow rate at 2 kilopascal (kPa) with and without pre-soaking the sample to assess whether dry or wet conditions affect the flow rate. FIG. 16 illustrates that the wicking yarns perform better under the wet conditions. H2Ri is geotextile containing a non-texturized multi-lobal (4DG) fiber, and T16C is a geotextile containing round texturized fiber. Because of its shape has inherent capillary action, H2Ri has significantly better wicking capacity than T16C. However, after texturization, which results in increase in inter-fiber voids, wicking performance of H2Ri and T16C were comparable, demonstrating the effect of inter-fiber voids and texturization. Because of presence of optimized inter-fiber voids with a suitable void ratio (0.8 to 5), round textured PET fibers like T16C perform as well as multi-lobal fiber H2Ri, which is unexpected as round fibers would not be expected to have better wicking performance than non-round fibers.

Example 8: Wet Front Movement Along Geotextile in the Horizontal Plane

Figure 17:
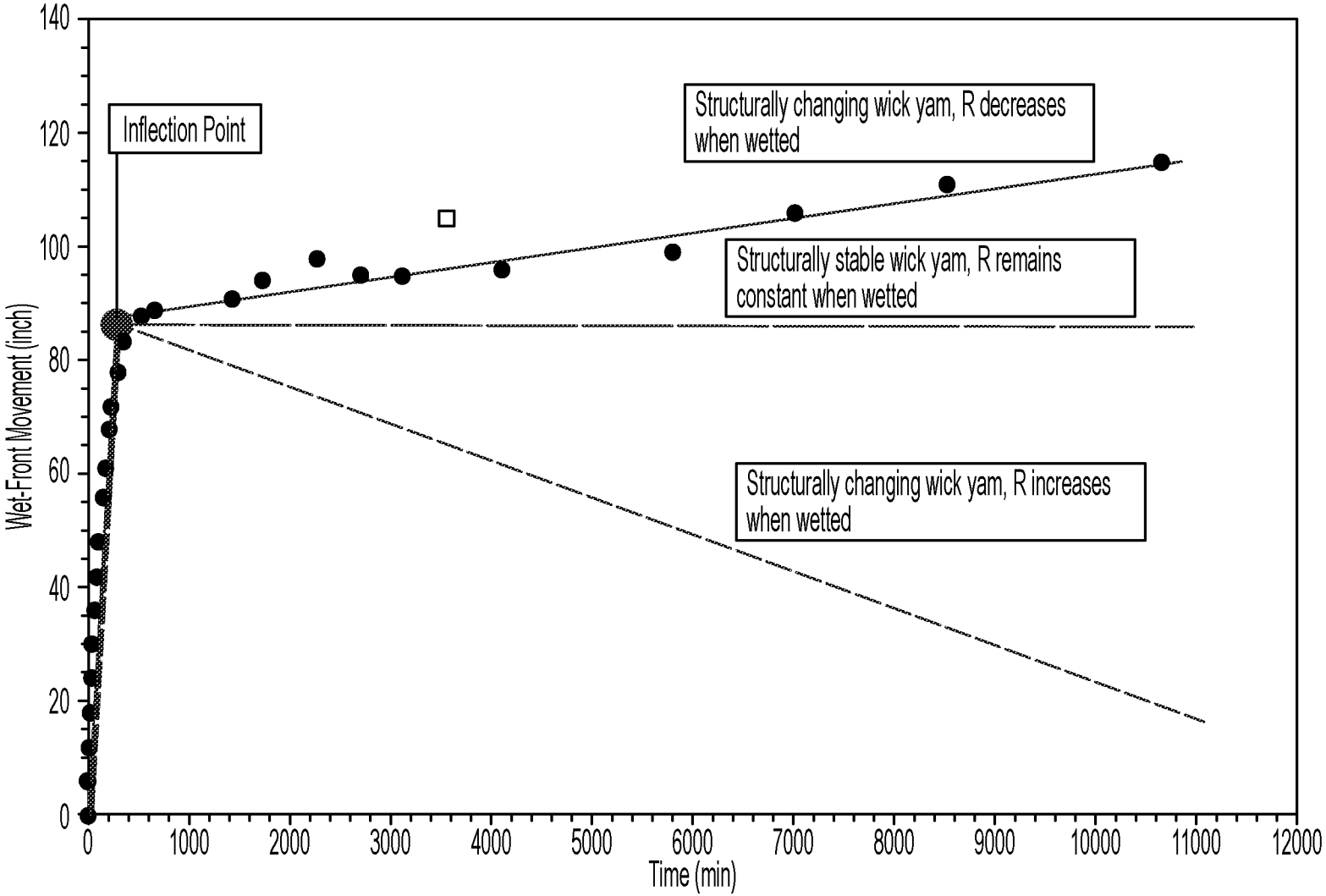
FIG. 17 illustrates the effect of structurally changing the wicking yarn on the effective capillary radius (R) of the wicking yarn.

FIG. 17 illustrates the effect of structurally changing the wicking yarn on the effective capillary radius (R) of the wicking yarn. For structurally stable wicking yarn, R remains constant when the wicking yarn is wetted. On the other hand, structurally changing the wicking yarn causes R to increase or decrease when the yarn is wetted.

Figure 18:
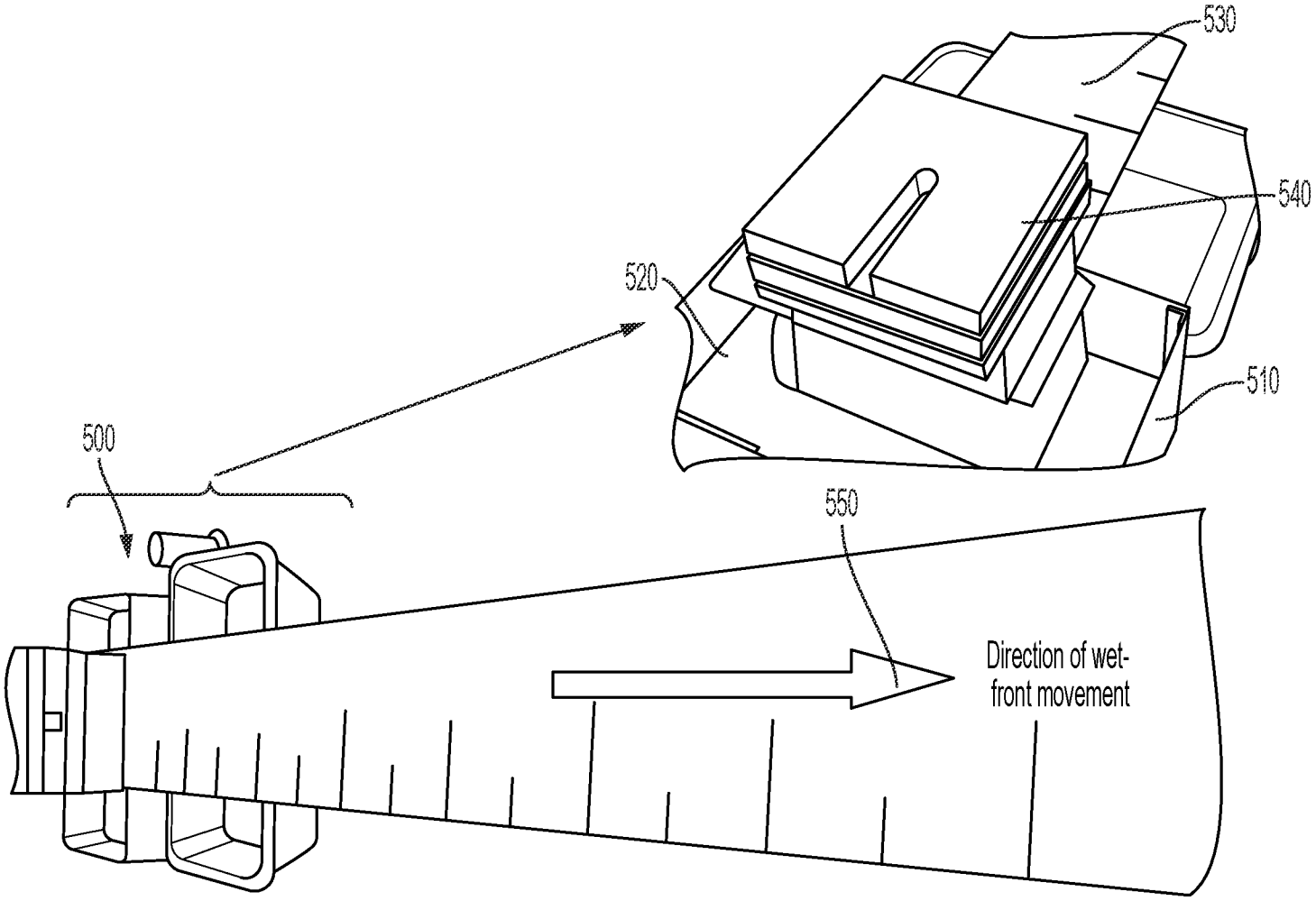
FIG. 18 shows a setup for a wet front movement measurement experiment.

FIG. 18 shows a setup 500 for a wet front movement measurement experiment. A tank 510 is filled with distilled deionized water and a constant head (constant water level) 520 is kept in the tank. The fabric 530 is submerged in the tank 510 and fixed at the bottom using a sufficient weight 540 to hold the fabric 530. Water is observed to move along the axis 550 of the fabric and measured for distance while recording the time at each distant interval.

Figure 19:
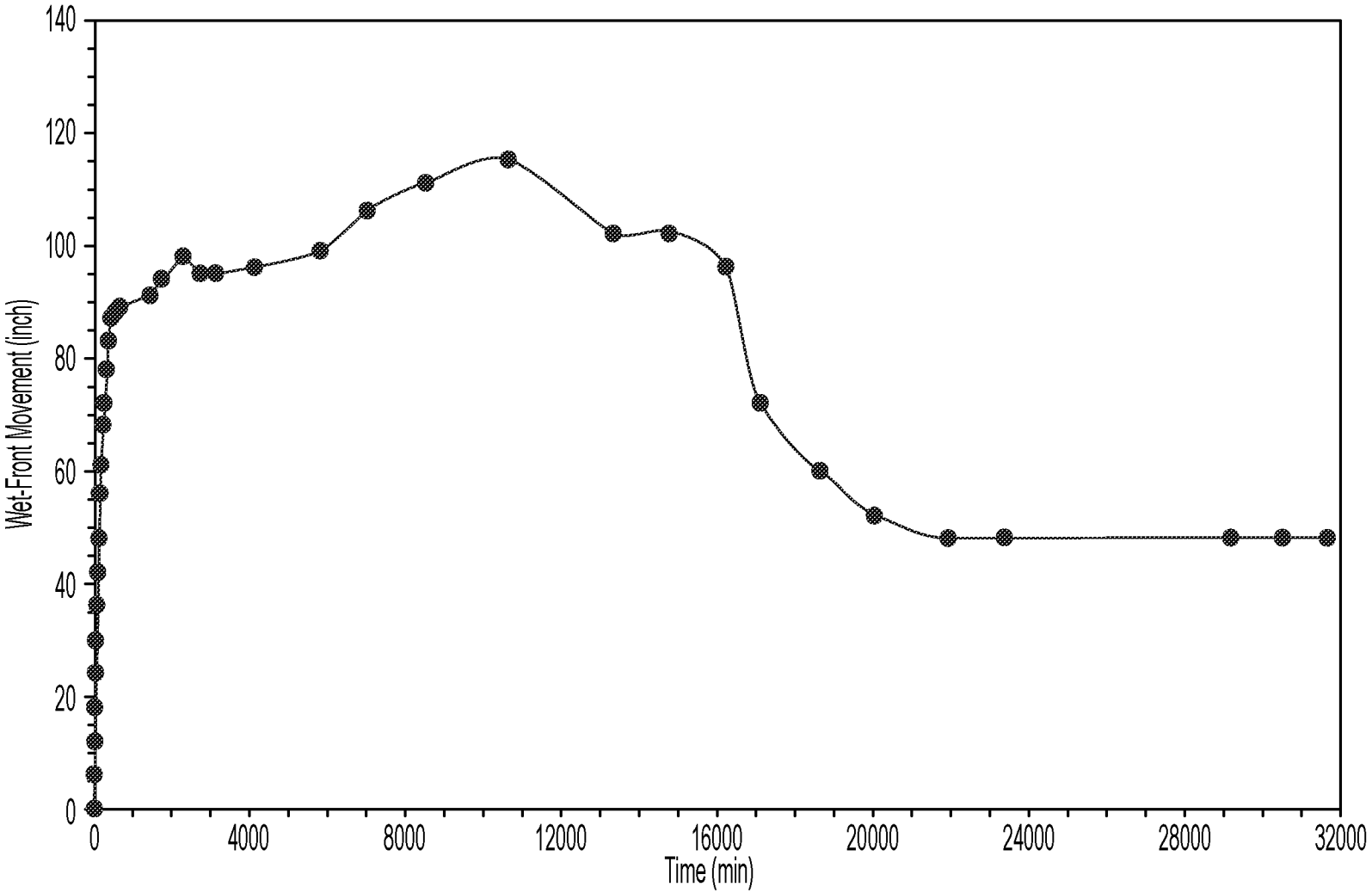
FIG. 19 is a graph showing a wet front movement along the geotextile fabric with textured (or texturized) polyester (PET) yarns in the cross direction or the cross machine direction (CMD) in the horizontal plane using a modified American Society for Testing and Materials (ATSM) C 1559 method.

Table 8 and FIG. 19 show the results of wet front movement along geotextiles in the horizontal plane using a modified ATSM C 1559 test for the Geotextile fabric with Textured PET Yarn in cross machine direction (CMD). FIG. 19 shows a graph of a wet front movement along the horizontal plane for a geotextile fabric sample PD-1C-20-304-01-16C, which is a wicking geotextile with a round texturized polyester (PET) yarn in the cross direction or cross machine direction (CMD). The water transport was measured in the horizontal plane using a modified American Society for Testing and Materials (ATSM) C 1559 method (Standard Test Method for Determining Wicking of Fibrous Glass Blanket Insulation (Aircraft Type)). The method uses a 1-inch×6-inch test specimen, which is too small for geotextiles in civil engineering applications. Therefore, the specimen size was modified to be 12-inch wide by roll width.

Figure 20:
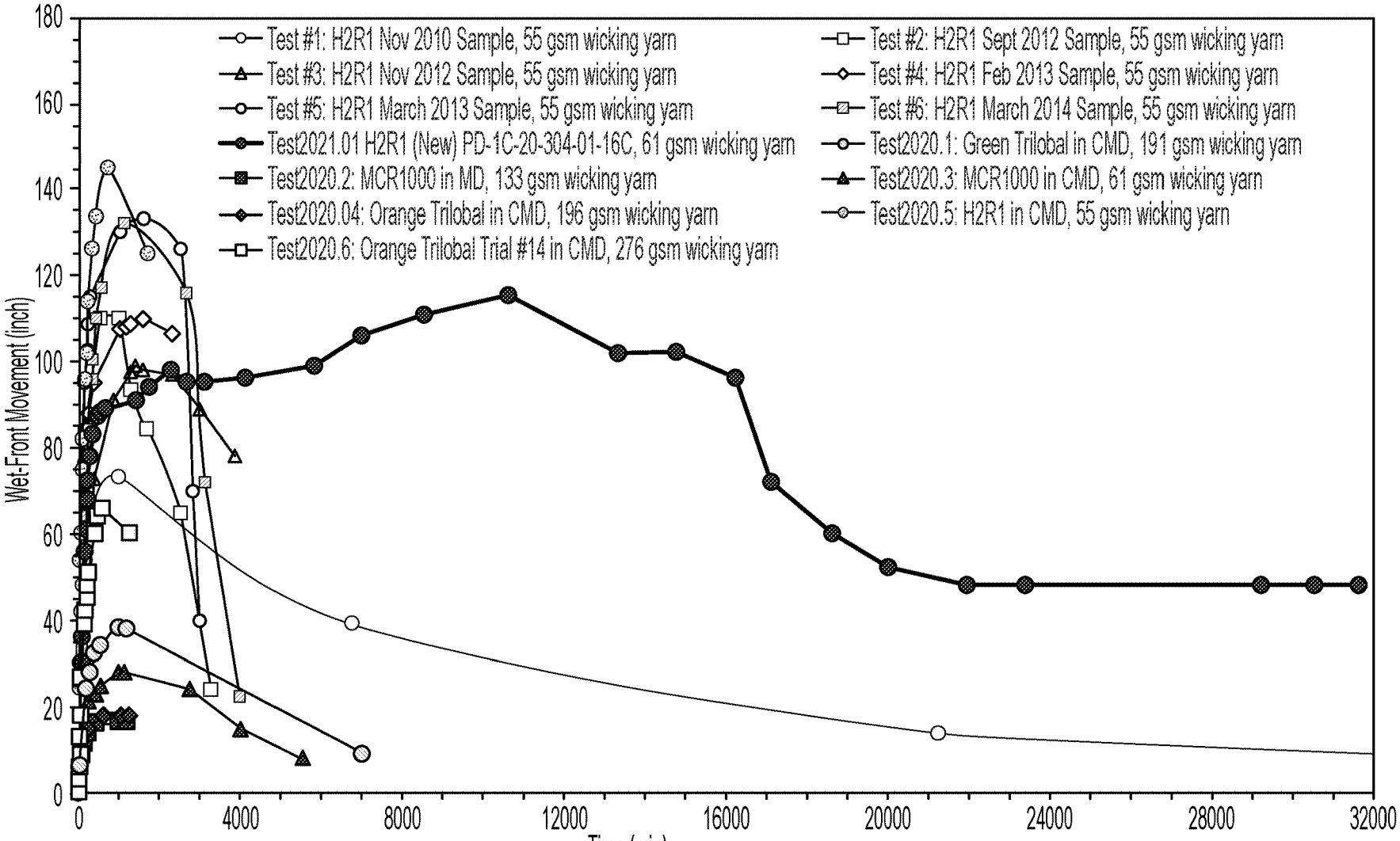
FIG. 20 is a graph showing a wet front movement along the geotextile fabric samples in the horizontal plane using a modified ATSM C 1559 method.

FIG. 20 shows results for wet front movement along geotextiles in the horizontal plane using the modified ATSM C 1559 test. Six H2Ri geotextile samples, six trial samples with trilobal shaped wicking fibers, and H2Ri fabrics with round textured PET yarns substituted for non-texturized nylon multi channeled wicking yarn in the CMD (sample PD-1C-20-304-01-16C shown in FIG. 19) were analyzed. As shown in FIG. 20, textured sample, PD-1C-20-304-01-16C showed improved wicking performance compared to all other samples.

TABLE 8

Wet front movement along the horizontal plane for a geotextile fabric sample PD-1C-20-304-01-16C (using ATSM C 1559 modified method).

| Test Conditions | Time (hh/mm/ss) | Duration (min) | Wet-front movement (m) | Wet-front velocity (m/hr) |
|---|---|---|---|---|
| Test Specimen: 12" wide | 12:05:00 | 0.0 | 0.0 | 0.0 |
| by full roll width | 12:08:00 | 3.0 | 6.0 | 120.0 |
| Hydraulic gradient = 0 | 12:14:00 | 9.0 | 12.0 | 60.0 |
| Flow Direction: | 12:25:00 | 20.0 | 18.0 | 32.7 |
| horizontal and parallel | 12:38:00 | 33.0 | 24.0 | 27.7 |
| to CMD | 12:53:00 | 48.0 | 30.0 | 24.0 |
| Temperature: 72+/2° F. | 13:13:00 | 68.0 | 36.0 | 18.0 |
| NOTE: The wet-front | 13:36:00 | 91.0 | 42.0 | 15.7 |
| velocity is defined as | 14:00:00 | 115.0 | 48.0 | 15.0 |
| incremental wet- | 14:38:00 | 153.0 | 56.0 | 12.6 |
| front travel divided by | 15:03:00 | 178.0 | 61.0 | 12.0 |
| incremental time | 15:39:00 | 214.0 | 68.0 | 11.7 |

TABLE 8-continued

Wet front movement along the horizontal plane for a geotextile fabric sample PD-1C-20-304-01-16C (using ATSM C 1559 modified method).

| Test Conditions | Time (hh/mm/ss) | Duration (min) | Wet-front movement (m) | Wet-front velocity (m/hr) |
|---|---|---|---|---|
| | 16:05:00 | 240.0 | 72.0 | 9.2 |
| | 17:07:00 | 302.0 | 78.0 | 5.8 |
| | 18:10:00 | 365.0 | 83.0 | 4.8 |
| | 19:35:00 | 450.0 | 87.0 | 2.8 |
| | 21:00:00 | 535.0 | 88.0 | 0.7 |
| | 23:00:00 | 655.0 | 89.0 | 0.5 |
| | 12:00:00 | 1435.0 | 91.0 | 0.2 |
| | 17:00:00 | 1735.0 | 94.0 | 0.6 |
| | 2:00:00 | 2275.0 | 98.0 | 0.4 |
| | 9:15:00 | 2710.0 | 95.0 | −0.4 |
| | 15:50:00 | 3105.0 | 95.0 | 0.0 |
| | 8:40:00 | 4115.0 | 96.0 | 0.1 |
| | 12:50:00 | 5805.0 | 99.0 | 0.1 |
| | 9:00:00 | 7015.0 | 106.0 | 0.2 |
| | 10:00:00 | 8515.0 | 111.0 | 0.2 |
| | 21:35:00 | 10650.0 | 115.0 | 0.1 |
| | 18:30:00 | 13345.0 | 102.0 | 0.0 |
| | 18:30:00 | 14785.0 | 102.0 | 0.0 |
| | 18:30:00 | 16225.0 | 96.0 | 0.0 |
| | 9:20:00 | 17115.0 | 72.0 | −0.1 |
| | 10:30:00 | 18625.0 | 60.0 | −0.1 |
| | 10:00:00 | 20035.0 | 52.0 | −0.1 |
| | 18:00:00 | 21955.0 | 48.0 | −0.1 |

TABLE 8-continued

Wet front movement along the horizontal plane for a geotextile fabric sample PD-1C-20-304-01-16C (using ATSM C 1559 modified method).

| Test Conditions | Time (hh/mm/ss) | Duration (min) | Wet-front movement (m) | Wet-front velocity (m/hr) |
|---|---|---|---|---|
| | 18:00:00 | 23395.0 | 48.0 | −0.1 |
| | 19:00:00 | 29215.0 | 48.0 | −0.1 |
| | 17:00:00 | 30535.0 | 48.0 | −0.1 |
| | 12:00:00 | 31675.0 | 48.0 | −0.1 |

Example 9: Void Ratio for Textured and Nontextured Yarns

Table 9 shows the data for void area ($\mu m^2$) and void ratio for the tested wicking yarns. The prior art suggests that the higher the contact angle and the lower the polymer surface tension, the lower the wettability and water transport characteristics. However, inventors have unexpectedly discovered that creating inter-fiber voids in an optimized range improves the wettability and water transport characteristics of a yarn, thereby allowing even lower performing polymers to surpass higher performing polymers in wettability and water transport characteristics. This unexpected result lowers the cost and improves efficiency for water transport applications such as wicking drainage systems.

TABLE 9

Void area and void ratio for tested wicking yarns

| | | | | | | | | | | | |
|---|---|---|---|---|---|---|---|---|---|---|---|
| Void Ratio | 2.868 | 1.407 | 3.498 | 5.949 | 3.327 | 3.892 | 0.614 | 1.653 | 1.940 | 6.499 | 0.993 |
| Void Area ($\mu m^2$) | 2.74E+05 | 2.24E+04 | 8.94E+05 | 4.54E+05 | 1.87E+05 | 2.63E+05 | 1.00E+05 | 215E+05 | 6.65E+05 | 5.70+05 | 8.88E+04 |
| Comments | High air texturize | No air texturize | No twist, No air texturize | 1.5 turns/inch, No air texturize | Ultra-high air texturize | No air texturize | No air texturize | High air texturize | High air texturize | High air texturize | High air texturize |
| Denier (g/9 km) | 1140 | 600 | 3400 | 865 | 1800 | 1300 | 1000 | 1000 | 2000 | 865 | 1000 |
| Surface tension with water, $\tau$ ($mJ/m^2$) | 30 | 30 | 46.5 | 46.5 | 44.6 | 44.6 | 44.6 | 44.6 | 44.6 | 46.5 | 44.6 |
| Denier per filament (g/9 km) | 5 | 4 | 6 | 6 | 6.25 | 4 | 5 | 5 | 5 | 6 | 10 |
| $\tau$*cos($\theta$) | −6.24 | −6.24 | 17.42 | 17.42 | 13.78 | 13.78 | 13.78 | 13.78 | 13.78 | 17.42 | 13.78 |
| Contact Agnle, $\theta$ (°) | 102 | 102 | 68 | 68 | 72 | 72 | 72 | 72 | 72 | 68 | 72 |
| Filament Count | 216 | 144 | 566 | 144 | 288 | 325 | 192 | 192 | 384 | 144 | 100 |
| Shape | Delta | Delta | 4DG | 4DG | Round | Delta | Round | Round | Round | 4DG | Round |
| Material | PP | PP | Nylon | Nylon | PET | PET | PET | PET | PET | Nylon | PET |
| ID | 1 | 2 | 3 | 4 | 5 | 6 | 7 | 8 | 9 | 10 | 11 |

Figure 24:
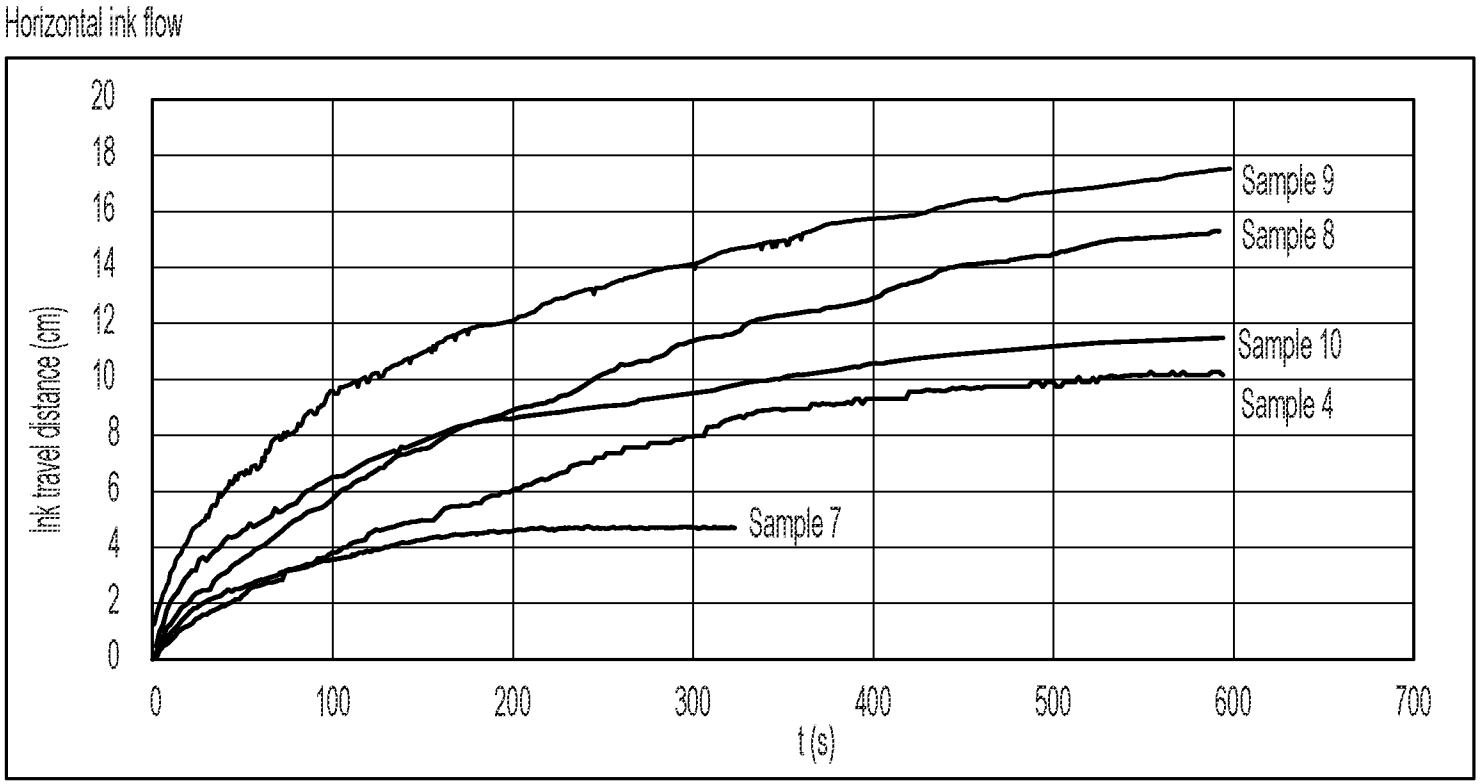
FIG. 24 shows results for horizontal flow test for fabric samples 4, 7, 8, 9, and 10 using an ATSM D 4716 test.

Table 9 shows the results for void ratio comparison for Samples 1 to 11. FIG. 24 shows results of horizontal flow tests for samples 1, 2, 4, and 7-11 using an ATSM D 4716 test.

Figure 21:
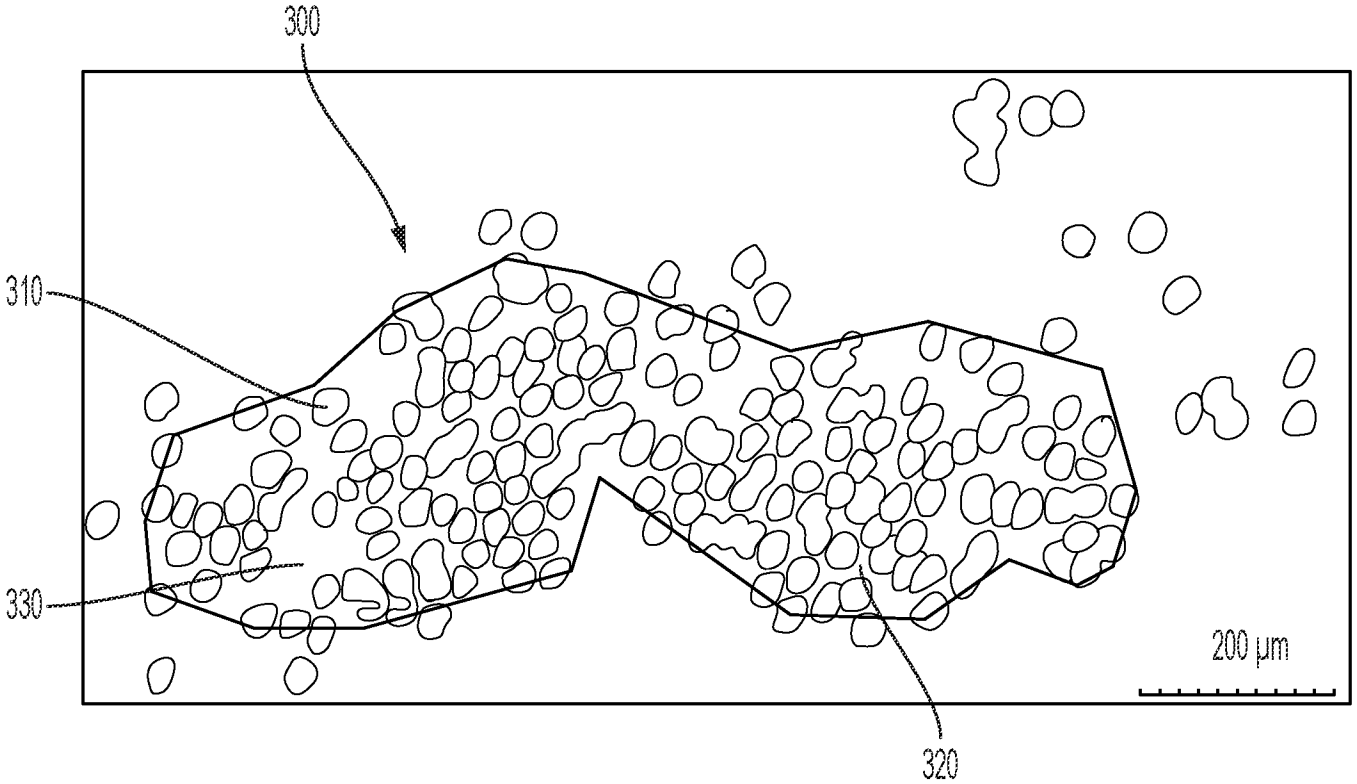
FIG. 21 shows a void ratio for fabric ample 7.
Figure 22:
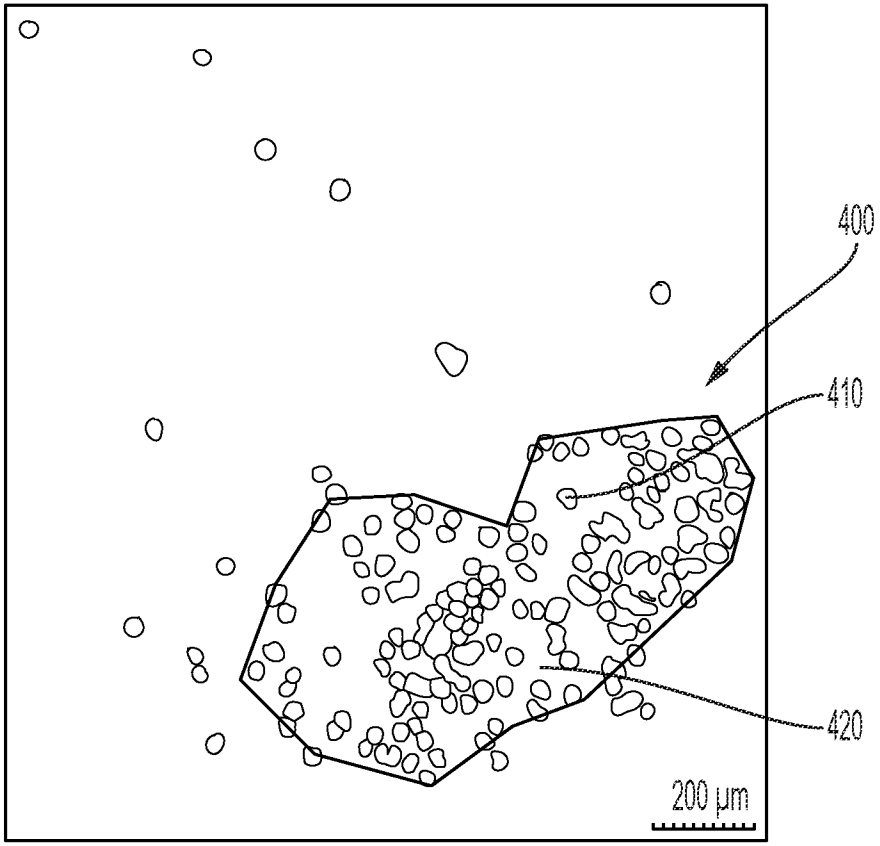
FIG. 22 shows a void ratio for fabric sample 8.
Figure 23:
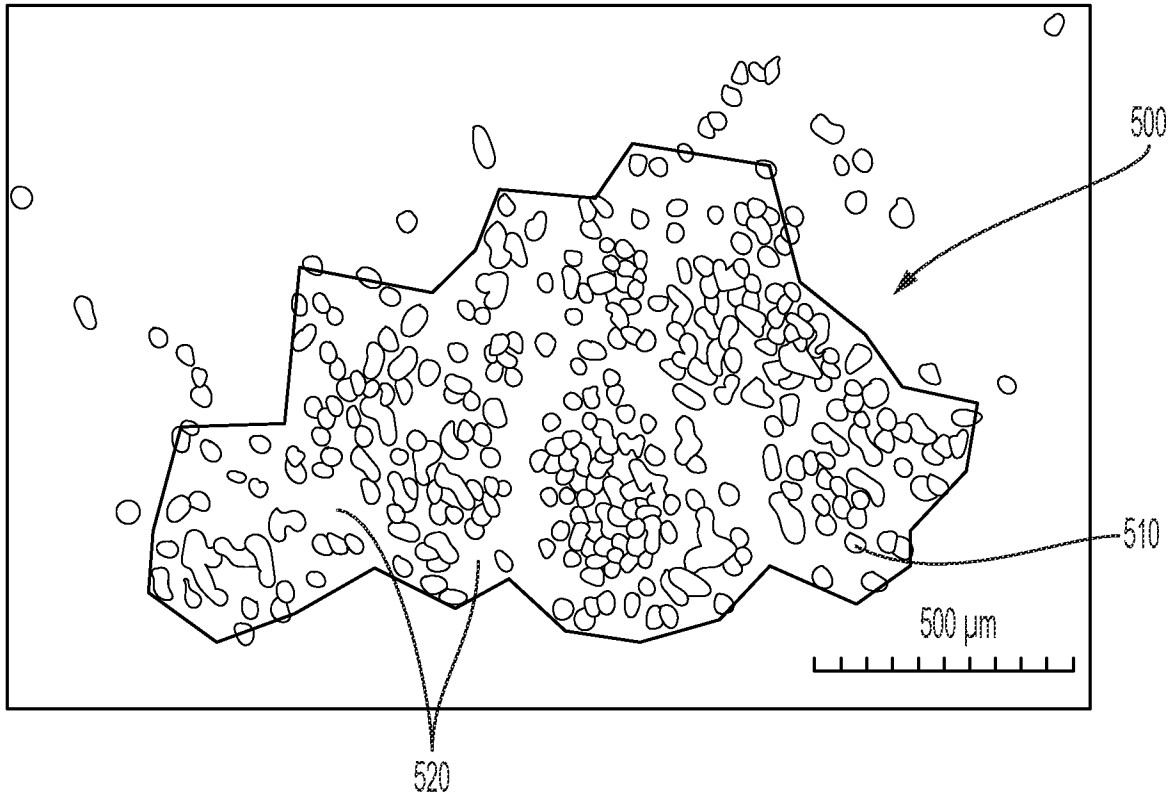
FIG. 23 shows a void ratio for fabric sample 9.

FIGS. 21 to 23 and Table 10 illustrate that air texturization improves void ratio. The void ratio is calculated dividing (the assumed cross section for water transport ($A_T$) minus (the number of filaments (n)×the individual filament cross section area ($A_f$) by (the number of filaments for water transport (n)×the individual filament cross section area ($A_f$)).

$$\text{Void ratio} = \frac{A_T - (n \times A_f)}{n \times A_f}$$

In Table 10 for example, the bounding area is the assumed cross section for water transport ($A_T$), the total number of filaments for water transport is the total number of filaments minus the number of filaments outside the bounding area, and the filament area is the individual filament area. For Sample 7, the void ratio is calculated as (263235−((192−28)×994.3)/((192−28)×994.3)=0.614. Sample 7, which is non-texturized sample, has a lower void ratio compared to air-texturized samples 8 and 9. FIG. 21 shows a non-texturized yarn 300 of sample 7, including a plurality of wicking yarns having a plurality of fibers 310 with inter-fiber voids 320 and 330. Inter-fiber voids of the non-texturized yarn 300 are either too small (inter-fiber voids 320) or too large (inter-fiber voids 330). These inter-fiber voids result in a lower void ratio, as shown in Table 9 and 10. The void ratio for sample 7 is about 0.6, which is not high enough to improve its wicking capabilities (see Examples 3 and 4 above).

FIGS. 22 and 23 show texturized geotextile yarn 400 (sample 8) and yarn 500 (sample 9), respectively. FIG. 22 shows the texturized yarn 400 for sample 8, in which the texturized yarn 400 includes a plurality of fibers 410 and inter-fiber voids 420. The inter-fiber voids 420 can be of different size and shape. The inter-fiber voids 420 created by texturization result in a void ratio of 1.653 (Table 10), which is higher than the void ratio for the non-texturized yarn 300 (FIG. 21). The higher void ratio results in improved performance for sample 8 relative to sample 7 (see Examples 3 and 4 discussed above to compare horizontal flow test results for samples 7 and 8). Similarly, FIG. 23 shows texturized yarn 500 of sample 9, which includes a plurality of fibers 510 and inter-fiber voids 520. The inter-fiber voids 520 can be of different size and shape. The inter-fiber voids 520 created by texturization result in a void ratio of 1.940 (Table 10), which is higher than the void ratio for the non-texturized yarn 300 (FIG. 21), resulting in an improved performance for sample 9 relative to sample 7 (see Example 3 discussed above).

FIG. 24 shows that texturized samples 8, 9 and 10 have longer duration and ink travel distances relative to non-texturized samples 4 and 7, which illustrates the effect of texturization on improving wicking properties by improving inter-fiber voids. Void ratio is a reliable criterion to measure improvement in inter-fiber void space. The fibers with a void ratio between about 0.8 to 5 show improved wicking performance (for example, samples 8 and 9) relative to fibers that have a void ratio either less than 0.8 (sample 7) or more than about 5 (sample 10).

TABLE 10

Void ratio comparison for samples 7, 8, and 9.

| Sample | Property | |
|---|---|---|
| Sample 7 | Filament area | 994.3 $\mu m^2$ |
| | Bounding area | 263235 $\mu m^2$ |
| | # filaments outside bounding area | 28 |
| | Total # of filaments | 192 |
| | Area of the filaments inside bounding area | 163065.2 $\mu m^2$ |
| | Void ratio | 0.614 |
| Sample 8 | Filament area | 806.2 $\mu m^2$ |
| | Bounding area | 344417.6 $\mu m^2$ |
| | # filaments outside bounding area | 31 |
| | Total # of filaments | 192 |
| | Area of the filaments inside bounding area | 129798.2 $\mu m^2$ |
| | Void ratio | 1.653 |
| Sample 9 | Filament area | 955.27 $\mu m^2$ |
| | Bounding area | 1008241 $\mu m^2$ |
| | # filaments outside bounding area | 25 |
| | Total # of filaments | 384 |
| | Area of the filaments inside bounding area | 342941.9 $\mu m^2$ |
| | Void ratio | 1.940 |

Assistance from Prof. Xiong Zhang, Ph.D., P. E. (Professor, Civil, Architectural, and Environmental Engineering, Missouri University of Science and Technology) and Mr. Javad Galinmoghadam, Ph.D. (Candidate, Geotechnical Engineering, Department of Civil, Architectural, and Environmental Engineering, Missouri University of Science and Technology) are acknowledged for obtaining the experimental results for void ratio, imaging analysis and flow rate calculations.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A geotextile fabric comprising: a plurality of wicking yarns each having a plurality of fibers with inter-fiber voids therebetween; wherein the inter-fiber voids of the plurality of wicking yarns have a water flow rate of about 0.05 milliliters per day per denier (ml/day/denier) to about 1.0 milliliters per day per denier, as measured by a modified American Society for Testing and Materials (ASTM D) 2434 method; wherein the plurality of wicking yarns have a void ratio of about 0.8 to about 5; and wherein the geotextile fabric is a nonwoven fabric.

2. The geotextile fabric of claim 1, wherein the plurality of wicking yarns each have a cross-sectional shape that is substantially round.

3. A geotextile fabric comprising: a plurality of wicking yarns each having a plurality of fibers with inter-fiber voids therebetween; wherein the inter-fiber voids of the plurality of wicking yarns have a water flow rate of about 0.05 milliliters per day per denier (ml/day/denier) to about 1.0 milliliters per day per denier, as measured by a modified American Society for Testing and Materials (ASTM D) 2434 method; wherein the plurality of wicking yarns have a void ratio of about 0.8 to about 5; and wherein the inter-fiber voids are formed by texturizing or a yarn bulking process.

4. The geotextile fabric of claim 3, wherein the plurality of wicking yarns each have a cross-sectional shape that is substantially round.

5. A geotextile fabric comprising: a plurality of wicking yarns each having a plurality of fibers with inter-fiber voids therebetween; wherein the inter-fiber voids of the plurality of wicking yarns have a water flow rate of about 0.05 milliliters per day per denier (ml/day/denier) to about 1.0 milliliters per day per denier, as measured by a modified American Society for Testing and Materials (ASTM D) 2434 method; wherein the plurality of wicking yarns comprises a plurality of textured wicking yarns; and wherein the plurality of textured wicking yarns have a void ratio of about 0.8 to about 5.

6. The geotextile fabric of claim 5, wherein the plurality of wicking yarns each have a cross-sectional shape that is substantially round.

7. The geotextile fabric of claim 5, wherein the plurality of textured wicking yarns comprises an air texturized wicking yarn, a mechanically texturized wicking yarn with friction or air, a staple spun texturized wicking yarn, or a combination thereof.

8. The geotextile fabric of claim 7, wherein the plurality of textured wicking yarns comprises the air texturized wicking yarn.

9. A geotextile fabric comprising: a plurality of texturized fibers with inter-fiber voids therebetween; wherein the geotextile fabric has a water flow rate of at least 2 liters/linear foot per day, as measured by a modified American Society for Testing and Materials (ASTM D) 2434 method; and wherein the plurality of texturized fibers have a void ratio of about 0.8 to about 5.

10. The geotextile fabric of claim 9, wherein the plurality of texturized fibers each have a cross-sectional shape that is substantially round.

11. The geotextile fabric of claim 9, wherein the geotextile fabric is a woven fabric, a nonwoven fabric, or a combination thereof.

12. The geotextile fabric of claim 9, wherein a fabric made from the geotextile fabric has a flow rate of about 2 liters per linear foot per day to about 10 liters per linear foot per day at zero gradient under load using American Society for Testing and Materials (ASTM) 4716 method.

13. The geotextile fabric of claim 11, wherein the geotextile fabric is a nonwoven fabric.

14. The geotextile fabric of claim 11, wherein the geotextile fabric is a woven fabric.

15. The geotextile fabric of claim 9, wherein a cross-sectional shape of each of the plurality of texturized fibers is round, oval, trilobal, multi lobed, dumbbell, multi channeled, triangular with round edges, pillowed, or a combination thereof.

16. The geotextile fabric of claim 9, wherein the plurality of texturized fibers comprises an air texturized fibers, a-mechanically texturized fibers with friction or air, a staple spun texturized fibers, or a combination thereof.

17. The geotextile fabric of claim 9, wherein a weight of each of the plurality of texturized fibers is between about 0.5 Denier and about 100 Denier per filament.

18. The geotextile fabric of claim 9, wherein each of the plurality of texturized fibers is a polyamide, a polyimide, a polyethylene, a polyester, a nylon, a polyolefin, a polystyrene, a cellulose ester, a cotton, a wool, a polyetheretherketone (PEEK), and natural fiber, or a combination thereof.

19. The geotextile fabric of claim 9, wherein each of the plurality of texturized fibers is a poly (ethylene terephthalate).

20. The geotextile fabric of claim 9, wherein each of the plurality of texturized fibers is a polypropylene.

21. The geotextile fabric of claim 9, wherein each of the plurality of texturized fibers is a nylon.

22. A method for making a geotextile fabric comprising a plurality of wicking yarns each having a plurality of fibers with inter-fiber voids therebetween; wherein the inter-fiber voids of the plurality of wicking yarns have a water flow rate of about 0.05 milliliters per day per denier (ml/day/denier) to about 1.0 milliliters per day per denier, as measured by a modified American Society for Testing and Materials (ASTM D) 2434 method; the method comprising: weaving the plurality of wicking yarns in an axis of fabric; and texturizing a substantially round yarns to form the plurality of wicking yarns each having a plurality of fibers with inter-fiber voids therebetween; wherein the plurality of textured wicking yarns have a void ratio of about 0.8 to about 5.

23. A method for making a geotextile fabric comprising a plurality of wicking yarns each having a plurality of fibers with inter-fiber voids therebetween; wherein the inter-fiber voids of the plurality of wicking yarns have a water flow rate of about 0.05 milliliters per day per denier (ml/day/denier) to about 1.0 milliliters per day per denier, as measured by a modified American Society for Testing and Materials (ASTM D) 2434 method; the method comprising: forming a nonwoven fabric from the plurality of wicking yarns.; weaving a polymeric yarn in one axis of the geotextile fabric; and weaving the plurality of wicking yarns with the polymeric yarn in another axis of the fabric, each wicking yarn of the plurality of wicking yarns having a cross-sectional shape that is substantially round and comprising a plurality of fibers with inter-fiber voids therebetween; wherein the plurality of wicking yarns have a void ratio of about 0.8 to about 5.

24. The method of claim 23, further comprising air texturizing a substantially round yarns to form the plurality of wicking yarns.

* * * * *